US007849535B2

(12) United States Patent
Tatsuno

(10) Patent No.: US 7,849,535 B2
(45) **Date of Patent: *Dec. 14, 2010**

(54) MAT, PILLOW AND SLEEPING BAG CONNECTABLE TO THE MAT, AND BEDDING INCLUDING ALL CONNECTED TO EACH OTHER

(75) Inventor: Isamu Tatsuno, Osaka (JP)

(73) Assignee: Mont-Bell Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/122,660

(22) Filed: May 16, 2008

(65) Prior Publication Data

US 2008/0216238 A1 Sep. 11, 2008

Related U.S. Application Data

(62) Division of application No. 11/501,260, filed on Aug. 9, 2006.

(30) Foreign Application Priority Data

Aug. 11, 2005 (JP) ..... 2005-233764
Aug. 7, 2006 (JP) ..... 2006-214135

(51) Int. Cl.

| | |
|---|---|
| ***A47G 9/08*** | (2006.01) |
| ***A47C 27/08*** | (2006.01) |
| ***A47C 29/00*** | (2006.01) |
| *A41B 13/06* | (2006.01) |
| *A47G 9/02* | (2006.01) |
| *A47G 9/06* | (2006.01) |
| *A47C 17/00* | (2006.01) |

(52) U.S. Cl. ..... 5/413 AM; 5/413 R; 5/420; 5/417; 5/723

(58) Field of Classification Search ..... 5/420, 5/655.3, 706, 710, 486, 413, 417, 722, 723, 5/413 AM, 413 R
See application file for complete search history.

(56) References Cited

U.S. PATENT DOCUMENTS 65,262 A 5/1867 Ouroussoff (Continued)

FOREIGN PATENT DOCUMENTS

EP 0286291 A1 10/1988

(Continued)

OTHER PUBLICATIONS

Tatsuno, Isamu, et al., "Co-Pending U.S. Appl. No. 12/122,657, Entitled Mat, Pillow and Sleeping Bag Connectable to the Mat, and Bedding Including . . . ", filed May 16, 2008.

(Continued)

*Primary Examiner*—Michael Trettel
*Assistant Examiner*—Jonathan J Liu
(74) *Attorney, Agent, or Firm*—Vincent K. Gustafson; Intellectual Property/Technology Law

(57) ABSTRACT

A mat can be connected to a pillow, a sleeping bag, or other mats, and is comfortable to sleep on, sturdy, and convenient to carry around. A strap is provided on a mat body for attaching a pillow A mat may include multiple mat bodies each having first engaging members located near at least two corners located at the ends of a first diagonal line, and second engaging members for engaging with the first engaging members and located near at least two corners located at the ends of a second diagonal line intersecting with the first diagonal line, to connect mat bodies together. A mat body may be made of multiple laminated layers, with edges of an outer layer forming a joint distal from the mat edges on a surface where a user of mat lies down, or the reverse surface thereof.

6 Claims, 22 Drawing Sheets

U.S. PATENT DOCUMENTS

| | | | | |
|---|---|---|---|---|
| 2,324,665 | A * | 7/1943 | Ayres | 5/413 R |
| 2,368,220 | A | 1/1945 | Hinds | |
| 4,459,714 | A | 7/1984 | Lin | |
| 4,878,258 | A * | 11/1989 | Casey | 5/420 |
| 5,066,001 | A | 11/1991 | Wilkinson | |
| 5,740,566 | A | 4/1998 | Stacy | |
| 2004/0255379 | A1 | 12/2004 | Zheng | |
| 2007/0044236 | A1 | 3/2007 | Tatsuno | |

FOREIGN PATENT DOCUMENTS

| | | | |
|---|---|---|---|
| JP | H06-021451 | U | 3/1994 |
| JP | 07-012158 | U | 2/1995 |
| JP | 07-213337 | A1 | 8/1995 |
| JP | 08-215024 | A1 | 8/1996 |
| JP | 8-215024 | A1 | 8/1996 |
| JP | 10-201576 | A1 | 8/1998 |
| JP | 2000-308546 | A | 11/2000 |
| JP | 2002-315651 | A | 10/2002 |
| JP | 2005-006956 | A | 1/2005 |
| JP | 2005-006956 | A1 | 1/2005 |
| JP | 2005-034507 | A | 2/2005 |
| WO | 2004107933 | A2 | 12/2004 |

OTHER PUBLICATIONS

Tatsuno, Isamu, et al., "Co-Pending U.S. Appl. No. 12/122,647, Entitled Mat, Pillow and Sleeping Bag Connectable to the Mat, and Bedding Including . . . ", filed May 16, 2008.

Tatsuno, Isamu, et al., "Co-Pending U.S. Appl. No. 12/122,654, Entitled Mat, Pillow and Sleeping Bag Connectable to the Mat, and Bedding Including . . . ", filed May 16, 2008.

Joannides, F. et al., "Structural Steel Design to BS 5950: Part 1", 2002, pp. 64, 67-68, Publisher: Thomas Telford Publishing.

* cited by examiner

MAT, PILLOW AND SLEEPING BAG CONNECTABLE TO THE MAT, AND BEDDING INCLUDING ALL CONNECTED TO EACH OTHER

CROSS-REFERENCE TO RELATED APPLICATIONS

This application is a divisional of U.S. patent application Ser. No. 11/501,260 filed Aug. 9, 2006 and published as U.S. Patent Application Publication No. 2007/0044236A1 on Mar. 1, 2007, which application in turn claims benefit and priority of Japanese Patent Application No. 2005-233764 filed Aug. 11, 2005, and Japanese Patent Application No. 2006-214135 filed Aug. 7, 2006. The disclosures of all such U.S. and Japanese patent applications are incorporated herein by reference, in their entireties, for all purposes.

BACKGROUND OF THE INVENTION

The present invention relates to: a mat that is comfortable to lie on, sturdy, and conveniently portable and can be connected to a pillow, a sleeping bag, or other mat(s); a pillow and a sleeping bag that can be connected to the above-described mat; bedding including the above-described mat and pillow; and bedding including the above-described sleeping bag and mat.

When a rug, a mattress, an air mattress or the like (hereinafter simply referred to as a "mat") is used with a pillow for outdoor leisure, mainly in camps, as bedding for sleeping purposes, the pillow sometimes slips and moves away from a user's head. Particularly, a stuff bag or similar used as a pillow is made of slippery materials (fabrics) such as nylon taffeta and, therefore, it is known that such a pillow can easily slip and move away from its original position. This pillow slipping occurs when the pillow is placed and used on the mat, and also when the pillow is placed and used beside the mat. Even in the case of a mat used with a pillow mainly in a bedroom or the like, the pillow sometimes moves and slips away from a user's head while the user is sleeping. As a result, such a mat disturbs the user's sleep and makes the user uncomfortable while they are sleeping.

As an example of a conveniently portable mat, there is a leisure mat that has a band attached to one of its side edges on the back surface, that can be rolled into an easily portable shape (see JP-A-7-213337).

Moreover, there is a portable mat made by placing long and narrow rush-woven straw mat members side by side so that the joints are aligned along the widthwise direction of the mat, connecting the adjacent edges of the straw mat members with soft band cloth so as to make the mat foldable, and forming a handle and a bandage-like string at specified positions on any of the straw mat members (see JP-A-8-215024).

Furthermore, a mat made of a plurality of laminated layers and an air mat containing air are configured so that joint margins (adhesion margins) are formed at the ends (along the periphery or the edges) of the mat and are joined together (see JP-A-2005-6956 and JP-UM-A-7-12158).

There is also an air mat that realizes cushioning by having air injected into a flat-bag-shaped body, that is configured in such a way that a pillow part is provided as an independent air chamber at one end of the mat, and a main body excluding the pillow part is composed of at least two independent main air chambers, each of which is partitioned to form an intermeshing comb teeth shape. In this air mat, edge areas are provided along at least both side edges of the mat, and snap fasteners capable of connecting the mat with an adjacent mat are placed along the edge areas, and a plurality of air mats can be connected by fastening the snaps (see JP-A-10-201576).

However, the mats described in the aforementioned patent documents JP-A-7-213337, JP-A-8-215024, JP-A-2005-6956, and JP-UM-A-7-12158 are not designed to prevent a pillow from slipping and moving away from a desired position. Some of the aforementioned patent documents JP-A-7-213337, JP-A-8-215024, JP-A-2005-6956, and JP-UM-A-7-12158 are designed so that they can be carried easily, but the idea of dividing a mat into small mat pieces and connecting the mat pieces as necessary to form and use a mat of a desired size is not incorporated in those inventions.

Moreover, the mats described in JP-A-7-213337, JP-A-8-215024, JP-A-2005-6956, JP-UM-A-7-12158, and JP-A-10-201576 have joint margins along their edges, and the joint margins are joined together to form the mat. This configuration causes an increase in the material costs and weight of the mat. Also, since the joint parts are located along the edges, there is concern that the joint parts may easily break away.

In the air mat described in JP-A-10-201576, the pillow cannot be removed from the main body. This air mat is configured in such a way that it is connected to another air mat by fastening a plurality of snaps provided along the edges of the mat. This means that the snaps are located where a user lies down. Therefore, the use can feel bumps and the mat is uncomfortable to lie down on.

SUMMARY OF THE INVENTION

This invention was devised in light of the circumstances of the related art described above. It is an object of the invention to provide a mat that can be connected to a pillow or other mats, that is comfortable to lie on, sturdy, and convenient to carry around.

It is another object of the invention to provide a pillow that can be connected to the mat, that is comfortable to lie on, sturdy, and convenient to carry around.

It is a further object of the invention to provide a sleeping bag that can be connected to the mat, that is comfortable to lie on, sturdy, and convenient to carry around.

It is a still further object of the invention to provide bedding that includes the mat and the pillow, or the mat and the sleeping bag, that is comfortable to lie on, sturdy, and convenient to carry around.

In order to achieve the objects described above, provided is a mat including: a primary mat body; and a strap provided on the primary mat body and used to attach a pillow to the primary mat body.

In the mat configured in the manner described above, the pillow is attached with the strap to the primary mat body. It is possible to prevent the pillow from slipping and moving away from the user's head while they are sleeping, whether the primary mat body and the pillow are made of normal materials, or made of slippery materials. Therefore, the mat and the pillow do not disturb the user's sleep and are comfortable to lie on.

Unless specifically mentioned, the "mat" referred to in relation to the invention includes all possible products, such as a mattress, a sheet, a futon, and a rug, on which a user can sit or lie.

According to an aspect of the invention, the mat may be configured so that it further includes a connecting mat body connected to the primary mat body; wherein each of the primary mat body and the connecting mat body has first engaging members located near at least two corners located at the ends of a first diagonal line, and second engaging members for engaging with the first engaging members, the second engaging members located near at least two corners located at the ends of a second diagonal line intersecting with the first diagonal line, and wherein the first engaging members of the primary mat body engage with the second engaging members of the connecting mat body, which is adjacent to the primary mat body, and the second engaging members of the primary mat body engage with the first engaging members of the connecting mat body, which is adjacent to the primary mat body, thereby connecting the primary mat body and the connecting mat body.

Since the first engaging members and the second engaging members are located near the corners of the primary mat body and the connecting mat bodies as described above, when the primary mat body and the adjacent connecting mat body are connected to each other by having the first engaging members of the primary mat body engage with the second engaging members of the adjacent connecting mat body, and having the second engaging members of the primary mat body engage with the first engaging members of the adjacent connecting mat body, the first engaging members and the second engaging members do not bother the user and nothing makes the surface of the mat uncomfortable. Therefore, in addition to the advantageous effects described above, the user can further be comfortable to use the mat.

The mat can also be configured in such a way that it further includes a connecting mat body connected to the primary mat body; wherein each of the primary mat body and the connecting mat body has first engaging members at least both ends of one edge, and second engaging members for engaging with the first engaging members, the second engaging members located at least both ends of an edge on the other side of the primary mat body or the connecting mat body; and wherein the first engaging members of the primary mat body engage with the second engaging members of the connecting mat body, which is adjacent to the primary mat body, and the second engaging members of the primary mat body engage with the first engaging members of the connecting mat body, which is adjacent to the primary mat body, thereby connecting the primary mat body and the connecting mat body.

Since the first engaging members and the second engaging members are located at both ends of the edges of the primary mat body and the connecting mat body as described above, when the primary mat body and the adjacent connecting mat body are connected to each other by having the first engaging members of the primary mat body engage with the second engaging members of the adjacent connecting mat body, and having the second engaging members of the primary mat body engage with the first engaging members of the adjacent connecting mat body, the first engaging members and the second engaging members do not bother the user and nothing makes the surface of the mat uncomfortable. Therefore, in addition to the advantageous effects described above, the user can further be comfortable to use the mat.

The primary mat body can be configured in such a way that it is made by laminating a plurality of layers, and the edges of at least an uppermost layer are fixed to each other on the side where a user of the primary mat body lies down, or the reverse side thereof. Because of this configuration, it is unnecessary to join the plural layers along the edges of the primary mat body. Therefore, in addition to the aforementioned advantageous effects, the amount of materials constituting the primary mat body and the weight of the mat can be reduced. Moreover, since it is unnecessary to provide any joint margins for joining the side edges of the primary mat body, manufacturing costs can be reduced. Also, compared to the case where the edges are joined, it is possible to decrease the possibility of the fixed parts (or joint parts) breaking away.

The connecting mat body can be configured in such a way that it is made by laminating a plurality of layers, and the edges of at least an uppermost layer are fixed to each other on the side where a user of the connecting mat body lies down, or the reverse side thereof.

The mat according to an aspect of the invention can also include a length adjustment mechanism for adjusting the length of the strap. Because of this configuration, in addition to the aforementioned advantageous effects, the length of the strap can be adjusted according to the size of the pillow, thereby enhancing the versatility of the mat.

This strap can be configured in such a way that it can be used to attach or detach the pillow to or from the primary mat body and also bind the primary mat body. This configuration makes it possible to roll up or fold the primary mat body and bind it with the strap when not using the mat. Accordingly, the mat can be wrapped up for compact and convenient storage and can be carried around easily. Incidentally, this strap can be used to bind both the primary mat body and the connecting mat bodies. The strap may also be used to bind the pillow together with the mat.

According to another aspect of the invention, provided is a mat including a plurality of primary mat bodies, wherein each primary mat body has first engaging members located near at least two corners located at the ends of a first diagonal line, and second engaging members for engaging with the first engaging members, the second engaging members located near at least two corners located at the ends of a second diagonal line intersecting with the first diagonal line; and wherein the first engaging members of the primary mat body engage with the second engaging members of another mat body which is adjacent to the above mat body, and the second engaging members of the primary mat body engage with the first engaging members of the other mat body adjacent thereto, thereby connecting these mat bodies together.

In the mat configured in the manner described above, the first engaging members and the second engaging members are provided near the corners of the primary mat body. Accordingly, when the primary mat body and the adjacent connecting mat body are connected to each other by having the first engaging members of the primary mat body engage with the second engaging members of the adjacent connecting mat body, and having the second engaging members of the primary mat body engage with the first engaging members of the adjacent connecting mat body, the first engaging members and the second engaging members do not bother the user. As a result, nothing makes the surface of the mat uncomfortable and the user can be comfortable to use the mat.

Moreover, according to a further aspect of the invention, provided is a mat including a mat comprising a plurality of primary mat bodies, wherein each primary mat body has first engaging members located near at least two corners located at the ends of a first diagonal line, and second engaging members for engaging with the first engaging members, the second engaging members located near at least two corners located at the ends of a second diagonal line intersecting with the first diagonal line; and wherein the first engaging members of the primary mat body engage with the second engaging members of another mat body which is adjacent to the above mat body, and the second engaging members of the primary mat body engage with the first engaging members of the other mat body adjacent thereto, thereby connecting these mat bodies together.

In the mat configured in the manner described above, the first engaging members and the second engaging members are provided at both ends of the edges of the primary mat body. Accordingly, when the primary mat body and the adjacent mat body are connected to each other by having the first engaging members of the primary mat body engage with the second engaging members of the adjacent mat body, and having the second engaging members of the primary mat body engage with the first engaging members of the adjacent mat body, the first engaging members and the second engaging members do not bother the user. As a result, nothing makes the surface of the mat uncomfortable and the user can be comfortable to use the mat.

Also in this case, the primary mat body may be made by laminating a plurality of layers, and the edges of at least an uppermost layer may be fixed to each other on the side where a user of the primary mat body lies down, or the reverse side thereof.

According to an embodiment of the invention, the first engaging member may be a hole and the second engaging member may be a toggle for insertion into the hole. Also, the first engaging members and the second engaging members may be fasteners or hook-and-loop fasteners that engage with each other, and various configurations such as hooks, buttons and button holes, and zip fasteners may be used.

In the mat including a plurality of primary mat bodies, at least one of the primary mat bodies can have a different size from the size of the other mat bodies. If this configuration is applied, one of the primary mat bodies may be a smaller size than the other mat bodies and this different-sized mat body may be used in place of a pillow. In this case, for example, the height (or the entire thickness) of the different-sized mat body may be made higher than that of the other mat bodies in order to enhance the functionality of that mat body as the pillow.

According to a further aspect of the invention, a mat including a primary mat body made by laminating a plurality of layers is provided, wherein in the primary mat body, the edges of at least an uppermost layer are fixed to each other on the side where a user of the primary mat body lies down, or the reverse side thereof.

With the mat configured in the manner described above, it is unnecessary to join the plural layers along the edges of the primary mat body. Therefore, the amount of materials constituting the primary mat body and the weight of the mat can be reduced. Moreover, since it is unnecessary to provide any joint margins, the manufacturing cost can be reduced. Also, compared to the case where the edges are joined, it is possible to decrease the possibility of the fixed parts (or joint parts) breaking away.

The primary mat body may be configured in such a way that there is a space inside the primary mat body and a fluid can be kept in the space. Also, the connecting mat body may be configured in such a way that there is a space inside the connecting mat body and a fluid can be kept in the space.

According to a further aspect of the invention, provided is a pillow that can be connected to a mat having a first engaging member located near at least one corner located at either end of a first diagonal line, and a second engaging member for engaging with the first engaging member, the second engaging member located near at least one corner located at either end of on a second diagonal line intersecting with the first diagonal line, wherein the pillow has: a first engaging member that is located near at least one corner located at either end of a first diagonal line and engages with the second engaging member on the mat; and a second engaging member that is located near at least one corner located at either end of a second diagonal line intersecting with the first diagonal line and engages with the first engaging member on the mat.

The pillow configured in the manner described above is connected to the mat by having the first engaging member of the pillow engage with the second engaging member of the mat, and having the second engaging member of the pillow engage with the first engaging member of the mat. Therefore, it is possible to prevent the pillow from slipping or moving away from the user's head while they are sleeping, whether the pillow and the mat are made of normal materials, or made of slippery materials. As a result, the pillow and the mat do not bother the user and the user can sleep comfortably.

According to a further aspect of the invention, provided is a pillow that can be connected to a mat having first engaging members at both ends of at least one edge thereof, wherein the pillow has second engaging members located at both ends of at least one edge thereof, for engaging with the first engaging members on the mat.

The pillow configured in the manner described above is connected to the mat by having the second engaging members of the pillow engage with the first engaging members of the mat. Therefore, it is possible to prevent the pillow from slipping or moving away from the user's head while they are sleeping, whether the pillow and the mat are made of normal materials, or made of slippery materials. As a result, the pillow and the mat do not bother the user and the user can sleep comfortably.

According to a further aspect of the invention, provided is a pillow that can be connected to a mat that includes a plurality of primary mat bodies, wherein each primary mat body has first engaging members near at least two corners located at the ends of a first diagonal line, and second engaging members for engaging with the first engaging members, the second engaging members located near at least two corners located at the ends of a second diagonal line intersecting with the first diagonal line; and the first engaging members of the primary mat body engage with the second engaging members of another mat body which is adjacent to the above mat body, and the second engaging members of the primary mat body engage with the first engaging members of that other adjacent mat body, thereby connecting the mat bodies together; and wherein the pillow has: a first engaging member that is located near at least one corner located at either end of a first diagonal line and engages with the second engaging member on the mat; and a second engaging member that is located near at least one corner located at either end of a second diagonal line intersecting with the first diagonal line and engages with the first engaging member on the mat.

The pillow configured in the manner described above is connected to the mat by having the first engaging member of the pillow engage with the second engaging member of the mat and having the second engaging member of the pillow engage with the first engaging member of the mat. Therefore, it is possible to prevent the pillow from slipping or moving away from the user's head while they are sleeping, whether the pillow and the mat are made of normal materials, or made of slippery materials. As a result, the pillow and the mat do not bother the user and the user can sleep comfortably.

According to a further aspect of the invention, provided is a pillow that can be connected to a mat that includes a plurality of primary mat bodies, wherein each primary mat body has first engaging members at least both ends of one edge, and second engaging members for engaging with the first engaging members, the second engaging members located at least both ends of an edge on the other side of the primary mat body; and wherein the first engaging members of the primary mat body engage with the second engaging members of another mat body which is adjacent to the above mat body, and the second engaging members of the primary mat body engage with the first engaging members of that other adjacent mat body, thereby connecting these mat bodies together; and wherein the pillow has second engaging members located at both ends of at least one edge, for engaging with the first engaging members formed on the mat.

The pillow configured in the manner described above is connected to the mat by having the second engaging members of the pillow engage with the first engaging members of the mat. Therefore, it is possible to prevent the pillow from slipping or moving away from the user's head while they are sleeping, whether the pillow and the mat are made of normal materials, or made of slippery materials. As a result, the pillow and the mat do not bother the user and the user can sleep comfortably.

According to a further aspect of the invention, provided is a sleeping bag that can be connected to a mat having first engaging members at least two of its corners, and second engaging members at least the other two corners, not the two corners mentioned above, for engaging with the first engaging members, and wherein the sleeping bag can be placed on the mat; and the sleeping bag has: first engaging members for engaging with the second engaging members of the mat, that are located at least two positions allowing engagement with the second engaging members of the mat; and second engaging members for engaging with the first engaging members of the mat, that are located at least two positions allowing engagement with the first engaging members of the mat when the sleeping bag is placed on the mat.

As an example of the above-described sleeping bag, the sleeping bag may be configured in such a way that the sleeping bag is able to be connected to a mat that has first engaging members located near at least two corners located at the ends of a first diagonal line, and second engaging members for engaging with the first engaging members, the second engaging members located near at least two corners located at the ends of a second diagonal line intersecting with the first diagonal line; wherein the sleeping bag can be placed on the mat; and the sleeping bag has: a second engaging member for engaging with the first engaging member of the mat, and a first engaging member for engaging with the second engaging member of the mat, wherein the first and second engaging members of the sleeping bag are located at positions spaced apart from each other along the edge of the sleeping bag where the user's head will be located when the user is in the sleeping bag; and the sleeping bag also has a second engaging member for engaging with the first engaging member of the mat, and a first engaging member for engaging with the second engaging member of the mat, wherein the first and second engaging members of the sleeping bag are located at positions spaced apart from each other along the edge of the sleeping bag where the user's feet will be located.

As another example of the above-described sleeping bag, it may be configured so that the sleeping bag is able to be connected to a mat that has first engaging members at least both ends of one edge, and second engaging members for engaging with the first engaging members, the second engaging members located at least both ends of an edge on the other side of the mat; wherein the sleeping bag can be placed on the mat; and the sleeping bag has: second engaging members for engaging with the first engaging members of the mat, that are located at positions spaced apart from each other for allowing engagement with the first engaging members of the mat and along the edge of the sleeping bag where the user's head will be located when the user is in the sleeping bag; and first engaging members for engaging with the second engaging members of the mat, that are located at positions spaced apart from each other for allowing engagement with the second engaging members of the mat and along the edge of the sleeping bag where the user's feet will be located.

According to a further aspect of the invention, provided is a sleeping bag that can be connected to a mat that has first engaging members near at least its four corners, wherein the sleeping bag can be placed on the mat and has second engaging members that engage with the first engaging members of the mat and are located at positions spaced apart from each other for allowing engagement with the first engaging members of the mat and along the edges where the user's head and feet will be located when the user is in the sleeping bag.

Any sleeping bag configured in the manner described above is connected to the mat by having the first engaging members engage with the second engaging members. Therefore, it is possible to prevent the sleeping bag from slipping or moving away from the mat while they are sleeping, whether the sleeping bag and the mat are made of normal materials, or made of slippery materials. As a result, the sleeping bag does not bother the user and the user can sleep comfortably. Also, since the sleeping bag is connected to the mat by means of engagement between the first engaging members and the second engaging members, the configuration employed is simple, and it is unnecessary to use a conventional type slip stopper that covers the entire mat.

The above-described sleeping bag can be placed on the aforementioned mat made by connecting a plurality of primary mat bodies together. Specifically speaking, as an example of this sleeping bag, it may be configured in such a way that a sleeping bag can be connected to a mat; and the mat includes a plurality of primary mat bodies, wherein each primary mat body has first engaging members near at least two corners located at the ends of a first diagonal line, and second engaging members for engaging with the first engaging members, the second engaging members located near at least two corners located at the ends of a second diagonal line intersecting with the first diagonal line; and wherein the first engaging members of the primary mat body engage with the second engaging members of another mat body which is adjacent to the above mat body, and the second engaging members of the primary mat body engage with the first engaging members of that other adjacent mat body, thereby connecting these mat bodies together; and the sleeping bag can be placed on the mat; and the sleeping bag has: a second engaging member for engaging with the first engaging member of the mat, and a first engaging member for engaging with the second engaging member of the mat, wherein the first and second engaging members of the sleeping bag are located at positions spaced apart from each other along the edge of the sleeping bag where the user's head will be located when the user is in the sleeping bag; and the sleeping bag also has a second engaging member for engaging with the first engaging member of the mat, and a first engaging member for engaging with the second engaging member of the mat, wherein the first and second engaging members of the sleeping bag are located at positions spaced apart from each other along the edge of the sleeping bag where the user's feet will be located.

In another example of the above-described sleeping bag, it may be configured in such a way that a sleeping bag can be connected to a mat; and the mat includes a plurality of primary mat bodies, wherein each primary mat body has first engaging members at both ends of one edge, and second engaging members for engaging with the first engaging members, the second engaging members located at least both ends of an edge on the other side of the primary mat body; and wherein the first engaging members of the primary mat body engage with the second engaging members of another mat body which is adjacent to the above mat body, and the second engaging members of the primary mat body engage with the first engaging members of that other adjacent mat body, thereby connecting these mat bodies together; and the sleeping bag can be placed on the mat; and the sleeping bag has: second engaging members for engaging with the first engaging members of the mat, that are located at least two positions spaced apart from each other for allowing engagement with the first engaging members of the mat and along the edge of the sleeping bag where the user's head will be located when the user is in the sleeping bag; and first engaging members for engaging with the second engaging members of the mat, that are located at least two positions spaced apart from each other for allowing engagement with the second engaging members of the mat and along the edge of the sleeping bag where the user's feet will be located.

According to a further aspect of the invention, provided is bedding including a mat and a pillow connected to the mat, wherein each of the mat and the pillow has a first engaging member located near at least one corner located at either end of a first diagonal line, and a second engaging member for engaging with the first engaging member, the second engaging member located near at least one corner located at either end of a second diagonal line intersecting with the first diagonal line; and wherein the first engaging member of the mat engage with the second engaging member of the pillow, and the second engaging member of the mat engages with the first engaging member of the pillow, thereby connecting the mat and the pillow together.

In this case, the mat can be configured so that it has first engaging members located near at least two corners located at the ends of a first diagonal line, and second engaging members that engage with the first engaging members and are located near at least two corners located at the ends of a second diagonal line intersecting with the first diagonal line.

According to a still further aspect of the invention, bedding including a mat and a pillow connected to the mat is provided, wherein the mat has first engaging members at least both ends of one edge of the mat, the pillow has second engaging members for engaging with the first engaging members, that are located at least both ends of one edge of the pillow, and the first engaging members of the mat engage with the second engaging members of the pillow, thereby connecting the mat and the pillow together.

In this case, the mat can be configured so that it has second engaging members that engage with the first engaging members, that are located at least both ends of an edge on the other side of the mat.

Moreover, the bedding described above can include a plurality of mats described above, and the mats can be connected to each other by having the first engaging members of the mat engage with the second engaging members of the adjacent mat, and having the second engaging members of the mat engage with the first engaging members of the adjacent mat.

In the bedding configured as described above, the pillow is connected to the mat by having the first engaging member of the pillow engage with the second engaging member of the mat and having the second engaging member of the pillow engage with the first engaging member of the mat. Therefore, it is possible to prevent the pillow from slipping or moving away from the user's head while they are sleeping, whether the pillow and the mat are made of normal materials, or made of slippery materials. As a result, the pillow and the mat do not bother the user and the user can sleep comfortably.

According to a further aspect of the invention, bedding including a mat and a sleeping bag attached to the mat is provided, wherein the mat has first engaging members at least two corners, and second engaging members at least the other two corners, not the two corners mentioned above, for engaging with the first engaging members, wherein the sleeping bag can be placed on the mat and has: first engaging members for engaging with the second engaging members of the mat, that are located at least two positions allowing engagement with the second engaging members of the mat; and second engaging member for engaging with the first engaging members of the mat, that are located at least two positions allowing engagement with the first engaging member of the mat when the sleeping bag is placed on the mat, and wherein the first engaging members of the mat engage with the second engaging members of the sleeping bag, and the second engaging members of the mat engage with the first engaging members of the pillow, thereby connecting the mat and the pillow together.

In an example of the above-described bedding, it may be configured in such a way that the bedding includes a mat and a sleeping bag attached to the mat, wherein the mat has first engaging members located near at least two corners located at the ends of a first diagonal line, and second engaging members that engage with the first engaging members and are located near at least two corners located at the ends of a second diagonal line intersecting with the first diagonal line; the sleeping bag can be placed on the mat; and the sleeping bag has: a second engaging member for engaging with the first engaging member of the mat, and a first engaging member for engaging with the second engaging member of the mat, wherein the first and second engaging members of the sleeping bag are located at positions spaced apart from each other along the edge of the sleeping bag where the user's head will be located when the user is in the sleeping bag; and the sleeping bag also has a second engaging member for engaging with the first engaging member of the mat, and a first engaging member for engaging with the second engaging member of the mat, and wherein the first and second engaging members of the sleeping bag are located at positions spaced apart from each other along the edge of the sleeping bag where the user's feet will be located; wherein the sleeping bag and the mat can be connected to each other by having the first engaging members of the mat engage with the second engaging members of the sleeping bag, and having the second engaging members of the mat engage with the first engaging members of the sleeping bag.

In another example of the above-described sleeping bag, it may be configured in such a way that the bedding includes a mat and a sleeping bag attached to the mat, wherein the mat has first engaging members at least both ends of one edge, and second engaging members that engage with the first engaging members and are located at least both ends of an edge on the other side of the mat; wherein the sleeping bag can be placed on the mat; and the sleeping bag has: second engaging members for engaging with the first engaging members of the mat, that are located at positions spaced apart from each other for allowing engagement with the first engaging members of the mat and along the edge of the sleeping bag where the user's head will be located when the user is in the sleeping bag; and first engaging members for engaging with the second engaging members of the mat, that are located at positions spaced apart from each other for allowing engagement with the second engaging members of the mat and along the edge of the sleeping bag where the user's feet will be located; wherein the sleeping bag and the mat can be connected to each other by having the first engaging members of the mat engage with the second engaging members of the sleeping bag, and having the second engaging members of the mat engage with the first engaging members of the sleeping bag.

In the bedding including the mat and the sleeping bag as described above, the sleeping bag is connected to the mat by having the first engaging members engage with the second engaging members. Therefore, it is possible to prevent the sleeping bag from slipping or moving away from the mat while they are sleeping, whether the sleeping bag and the mat are made of normal materials, or made of slippery materials. As a result, the sleeping bag does not bother the user and the user can sleep comfortably. Also, since the sleeping bag is connected to the mat by means of engagement between the first engaging members and the second engaging members, the configuration employed is simple, and it is unnecessary to use a conventional type slip stopper that covers the entire mat.

Furthermore, the bedding including the mat and the sleeping bag as described above can be configured in such a way that the bedding includes a plurality of mats, wherein the first engaging members of the mat engage with the second engaging members of another mat which is adjacent to the mat mentioned above, and the second engaging members of the mat mentioned above engage with the other mat which is adjacent to the mat mentioned above, thereby connecting these mats together.

According to a further aspect of the invention, provided is bedding including a mat and a sleeping bag attached to the mat, wherein the mat has first engaging members near at least its four corners; the sleeping bag can be placed on the mat; and the sleeping bag has second engaging members that engage with the first engaging members of the mat and are located at positions spaced apart from each other for allowing engagement with the first engaging members of the mat, and along the edges where the user's head and feet will be located respectively when the user is in the sleeping bag; and the sleeping bag is connected to the mat by having the first engaging members of the mat engage with the second engaging members of the sleeping bag.

Concerning the bedding including the mat and the sleeping bag as described above, the sleeping bag is connected to the mat by having the second engaging members of the sleeping bag engage with the first engaging members of the mat. Therefore, it is possible to prevent the sleeping bag from slipping or moving away from the mat while they are sleeping, whether the sleeping bag and the mat are made of normal materials, or made of slippery materials. As a result, the sleeping bag does not bother the user and the user can sleep comfortably. Also, since the sleeping bag is connected to the mat by means of engagement between the first engaging members and the second engaging members, the configuration employed is simple, and it is unnecessary to use a conventional type slip stopper that covers the entire mat.

In the bedding according to the aforementioned embodiment of the invention, a strap capable of binding at least the mat can be provided on the mat. By providing the strap on the mat, it is possible to roll up or fold the mat and bind it with the strap when the mat is not in use. Accordingly, the mat can be wrapped up for compact and convenient storage and be easily carried around. Incidentally, this strap can be used to bind not only the mat, but also the pillow or the sleeping bag together.

Moreover, the mat of the bedding described above may be configured in such a way that it is made by laminating a plurality of layers, and the edges of at least an uppermost layer are fixed to each other on the side where a user of the primary mat body lies down, or the reverse side thereof.

Furthermore, the aforementioned bedding may be configured in such a way that the first engaging member is a hole and the second engaging member is a toggle to be inserted into the hole. The first engaging members and the second engaging members may be fasteners or hook-and-loop fasteners that engage with each other, and various configurations such as hooks, buttons and button holes, and zip fasteners may be used.

In the mat according to an aspect of the invention, the pillow is attached with the strap to the primary mat body. Accordingly, it is possible to prevent the pillow from slipping and moving away from the user's head while they are sleeping, whether the primary mat body and the pillow are made of normal materials, or made of slippery materials. Therefore, the mat and the pillow do not disturb the user's sleep and have the advantageous effect of making a comfortable sleep possible.

In the mat according to another aspect of the invention, the first engaging members and the second engaging members are located near the corners of the primary mat body. Consequently, when the primary mat bodies are connected to each other by having the first engaging members engage with the second engaging members, the first engaging members and the second engaging members do not bother the user and nothing makes the surface of the mat uncomfortable. Therefore, the mat has the advantageous effect of making the user be comfortable to use the mat.

Furthermore, in the mat according to a further aspect of the invention, the first engaging members and the second engaging members are located at both ends of the edges of the primary mat body. Accordingly, when the primary mat bodies are connected to each other by having the first engaging members engage with the second engaging members, the first engaging members and the second engaging members do not bother the user and nothing makes the surface of the mat uncomfortable. Therefore, the mat has the advantageous effect of making the user be comfortable to use the mat.

In the mat according to a further aspect of the invention, the edges of at least an uppermost layer of the primary mat body, which is made by a plurality of laminated layers, are fixed to each other on the side of the primary mat body where a user lies down, or the reverse side thereof. Because of this configuration, it is unnecessary to join the plural layers along the edges of the primary mat body. Therefore, in addition to the aforementioned advantageous effects, the amount of materials constituting the primary mat body and the weight of the mat can be reduced. Moreover, since it is unnecessary to provide any joint margins, the manufacturing cost can be reduced. Also, compared to the case where the edges are joined, it is possible to decrease the possibility of the fixed parts (or joint parts) breaking away.

Concerning the pillow according to an aspect of the invention, the first engaging member and the second engaging member are provided near the corners of the pillow. Accordingly, the pillow can be connected to the mat by having the first and second engaging members of the pillow engage with the second and first engaging members of the mat respectively. Therefore, it is possible to prevent the pillow from slipping or moving away from the user's head while the user is sleeping. As a result, the pillow does not bother the user and has the advantageous effect of making the user be comfortable to use it.

With the pillow according to another aspect of the invention, the second engaging members are provided at both ends of at least one edge of the pillow. Accordingly, the pillow can be connected to the mat by having the second engaging members of the pillow engage with the first engaging members of the mat respectively. Therefore, it is possible to prevent the pillow from slipping or moving away from the user's head while the user is sleeping. As a result, the pillow does not bother the user and has the advantageous effect of making the user be comfortable to use it.

The sleeping bag according to an aspect of the invention has: second engaging members that engage with the first engaging members of the mat and are located at least two positions allowing engagement with the first engaging members of the mat; and first engaging members that engage with the second engaging members of the mat and are located at least two positions allowing engagement with the second engaging members of the mat. Accordingly, the sleeping bag can be connected to the mat by having the first and second engaging members of the sleeping bag engage with the second and first engaging members of the mat respectively. Therefore, it is possible to prevent the sleeping bag from slipping or moving away from the mat while the user is sleeping. As a result, the sleeping bag does not bother the user and has the advantageous effect of making the user be comfortable to use it.

The sleeping bag according to another aspect of the invention has second engaging members that engage with the first engaging members of the mat and are located at positions allowing engagement with the first engaging members of the mat. Accordingly, the sleeping bag can be connected to the mat by having the second engaging members of the sleeping bag engage with the first engaging members of the mat respectively. Therefore, it is possible to prevent the sleeping bag from slipping or moving away from the mat while the user is sleeping. As a result, the sleeping bag does not bother the user and has the advantageous effect of making the user be comfortable to use it.

The bedding according to an aspect of the invention includes a mat and a pillow, and the pillow can be connected to the mat. Therefore, it is possible to prevent the pillow from slipping or moving away from the user's head while the user is sleeping. As a result, the bedding does not bother the user and has the advantageous effect of making the user be comfortable to use it.

The bedding according to another aspect of the invention includes a mat and a sleeping bag, and the sleeping bag can be connected to the mat. Therefore, it is possible to prevent the sleeping bag from slipping or moving away from the mat while the user is sleeping. As a result, the bedding does not bother the user and has the advantageous effect of making the user be comfortable to use it.

DETAILED DESCRIPTION OF THE INVENTION

A mat according to preferred embodiments of this invention will be described below with reference to the attached drawings. The embodiments described below are for the purpose of describing this invention, but the invention is not limited only to these embodiments. Accordingly, this invention can be utilized in various ways unless the utilizations depart from the gist of the invention.

First Embodiment

Figure 1:
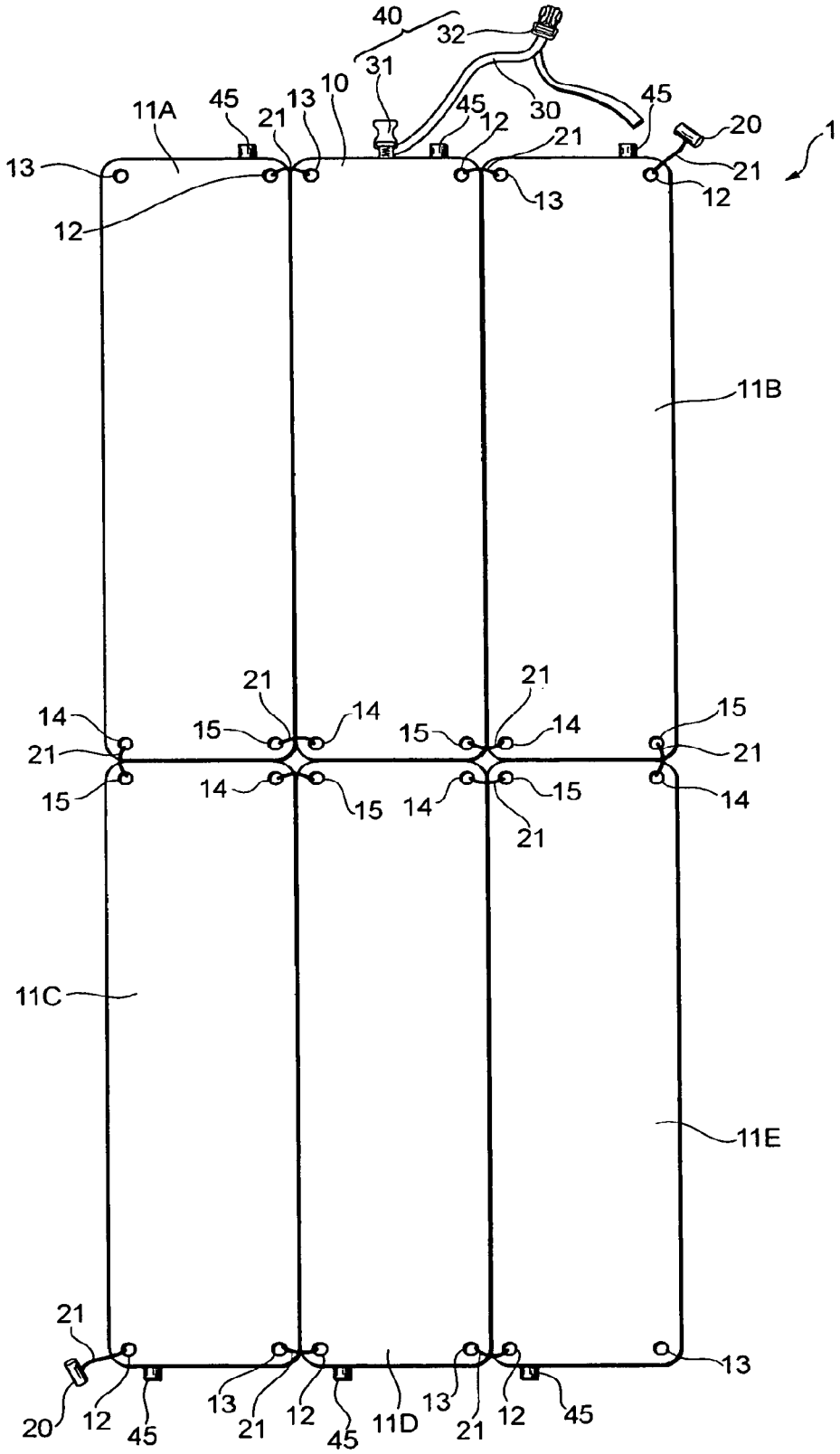
FIG. 1 is a plan view of a mat according to a first embodiment of this invention.
Figure 2:
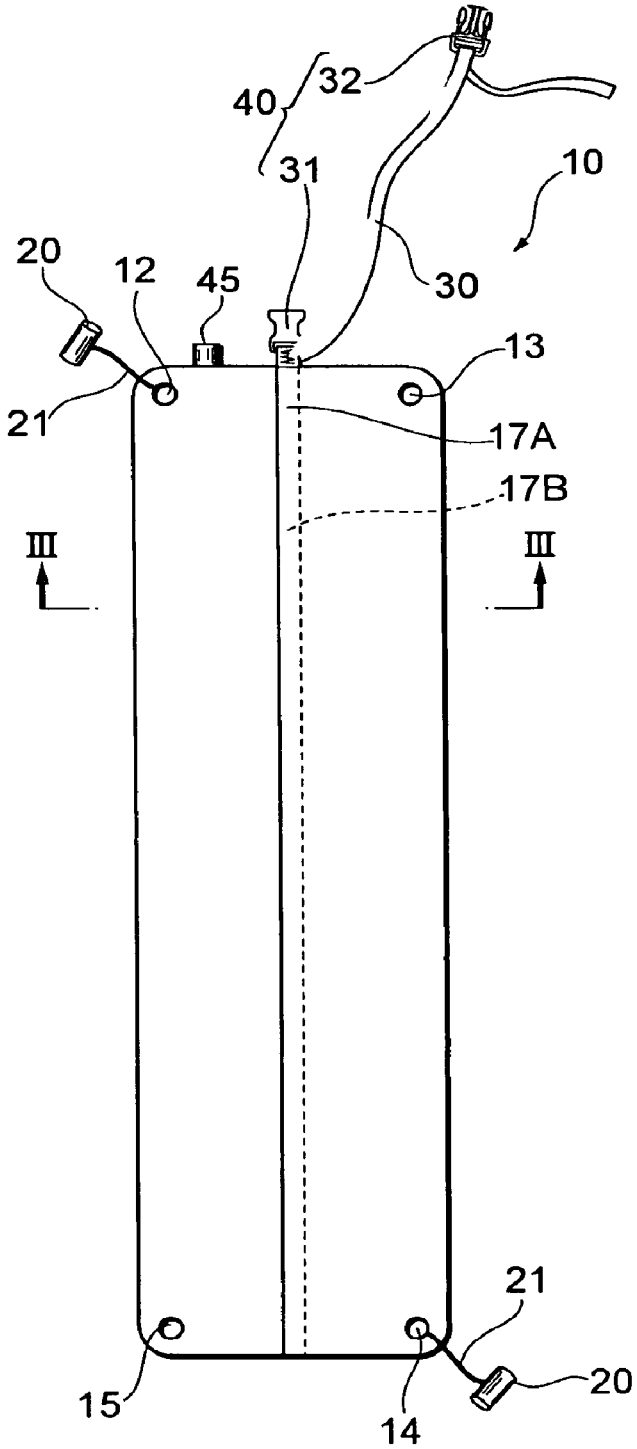
FIG. 2 is a bottom view of a primary mat body, a component of the mat shown in FIG. 1.
Figure 3:
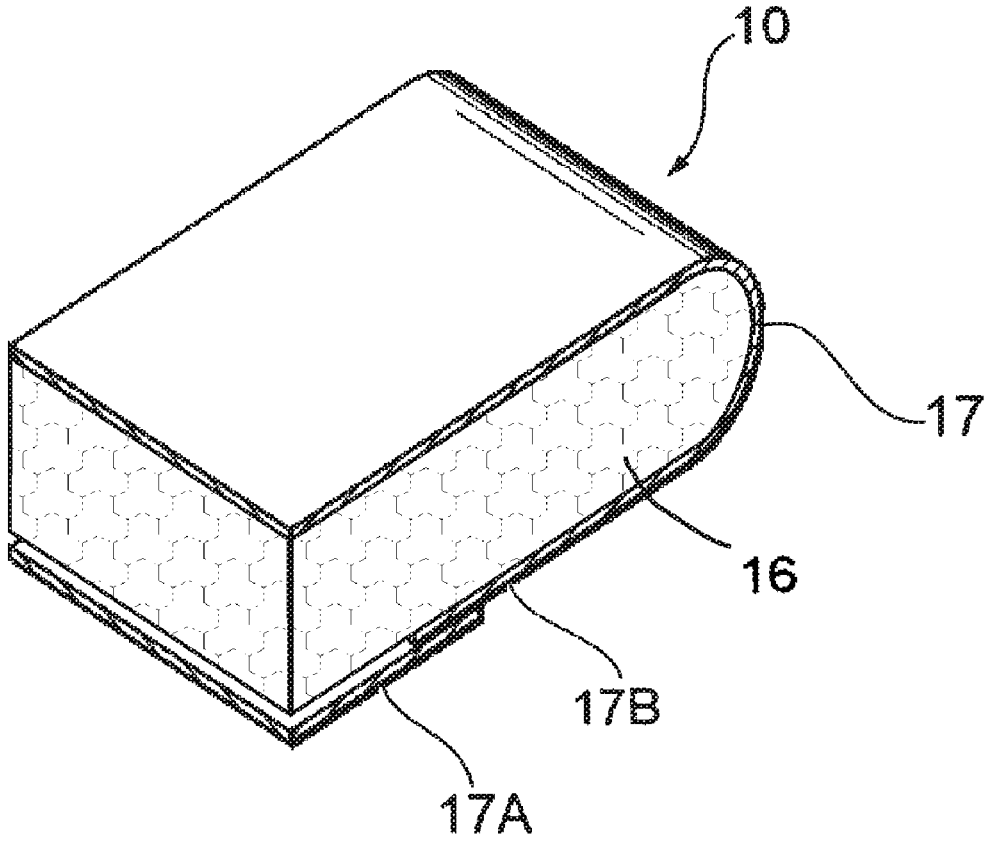
FIG. 3 is an enlarged perspective view of a sectioned part of the mat shown in FIG. 2 as taken along line III-III.
Figure 4:
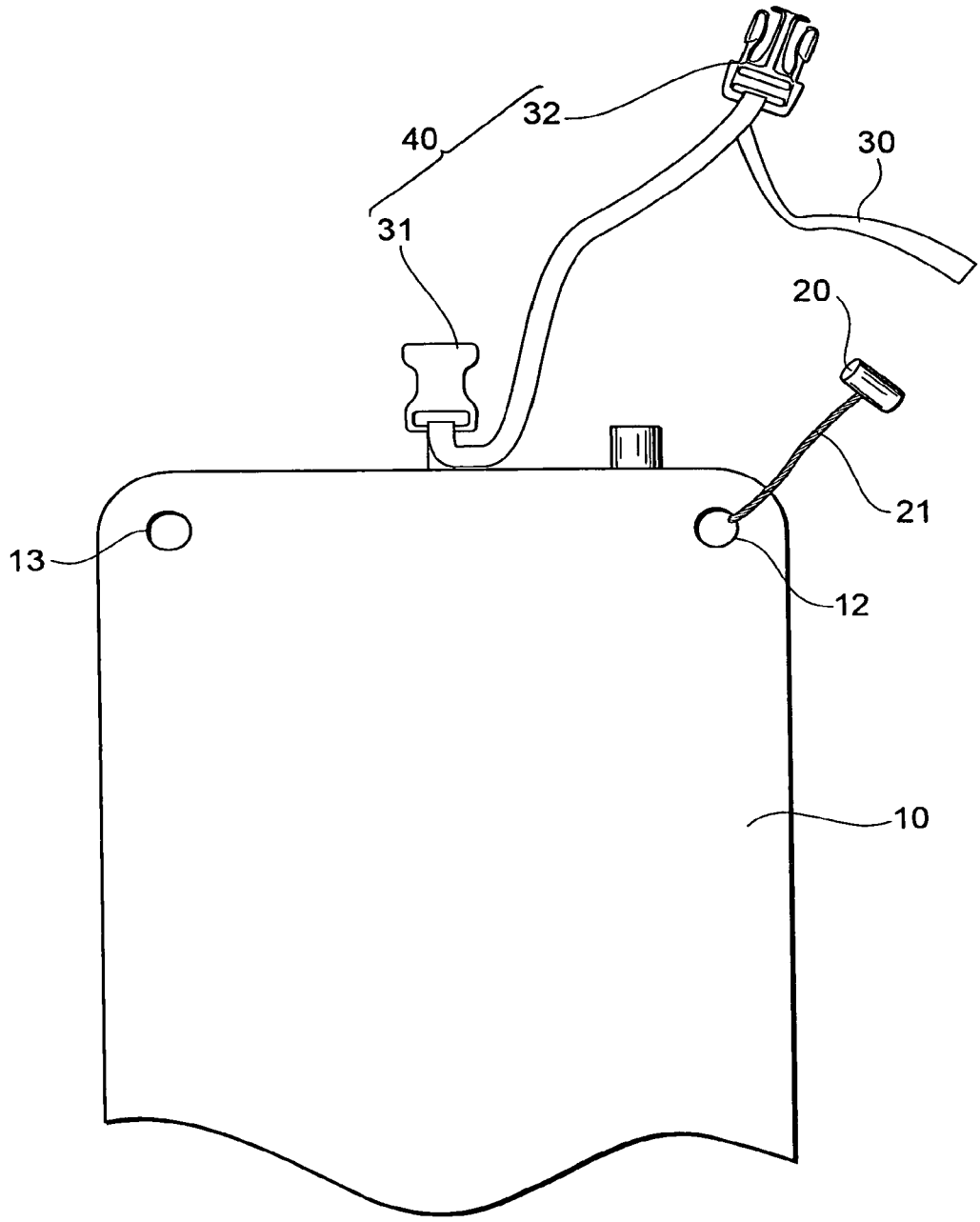
FIG. 4 is an enlarged plan view of an area where the strap is attached to the mat shown in FIG. 1.
Figure 5:
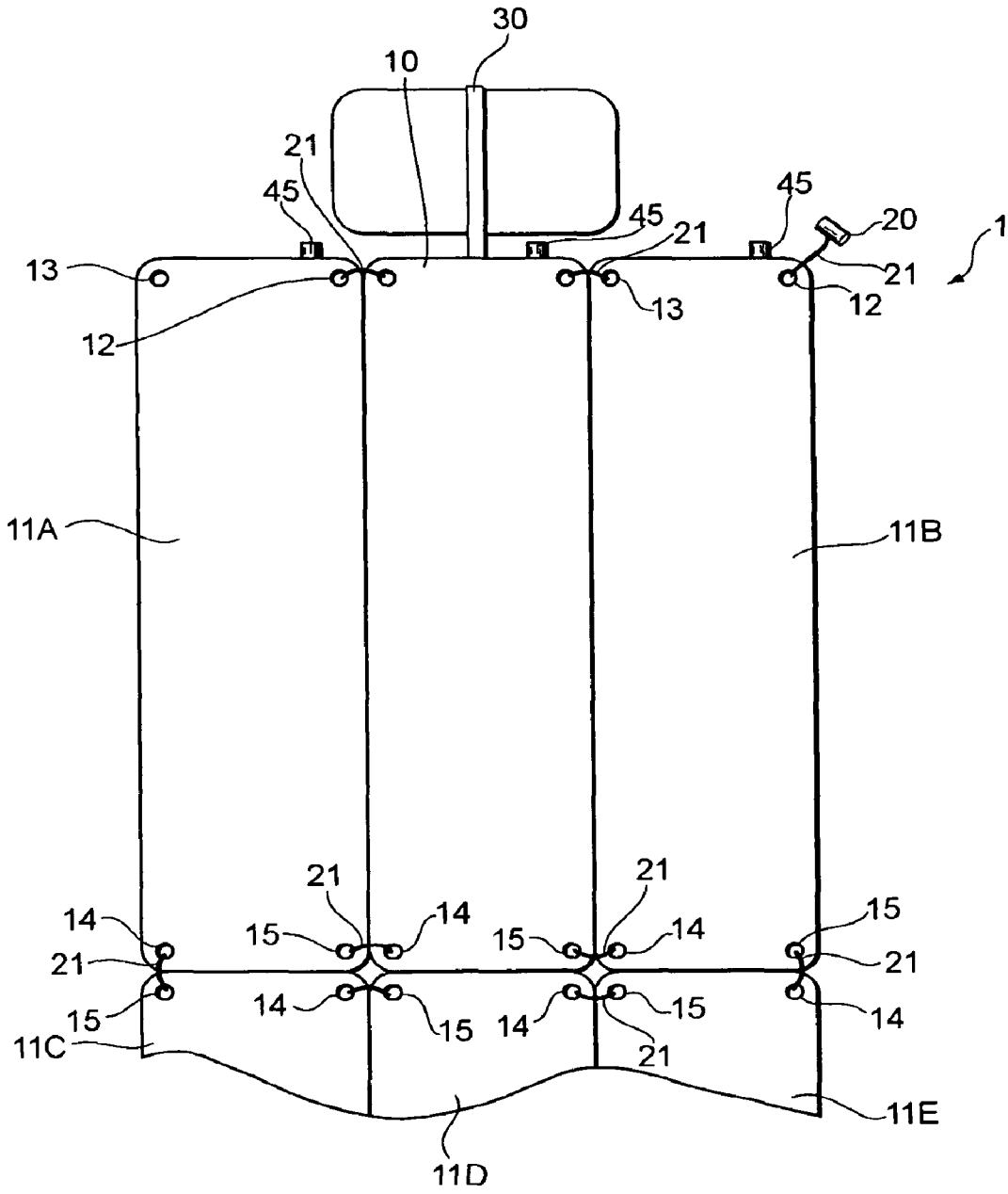
FIG. 5 is a plan view illustrating the state where the strap on the mat shown in FIG. 1 is used to attach a pillow to the mat.
Figure 6:
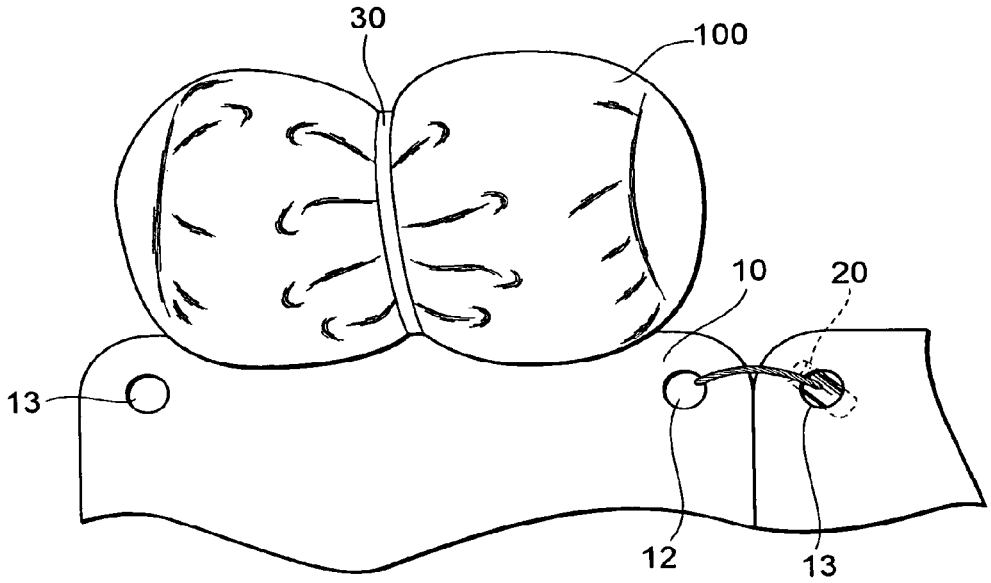
FIG. 6 is an enlarged perspective view illustrating the state where the strap on the mat shown in FIG. 1 is used to attach a pillow to the mat.
Figure 7:
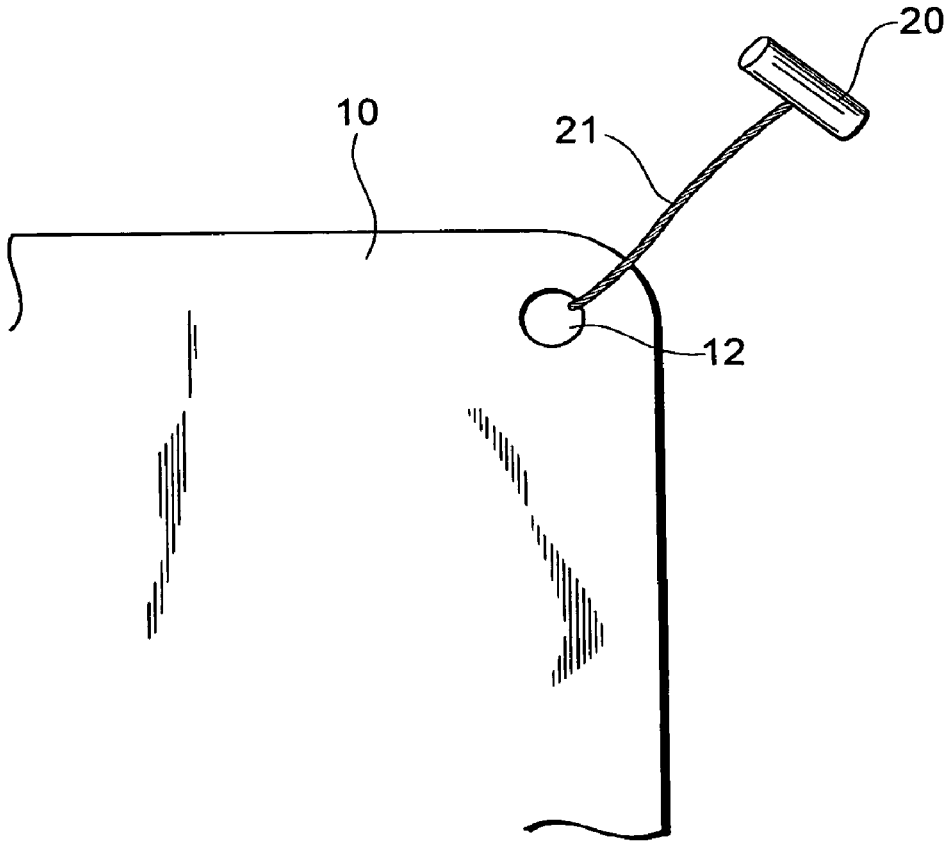
FIG. 7 is an enlarged plan view of the area around a first engaging member of the primary mat body shown in FIG. 1.
Figure 8:
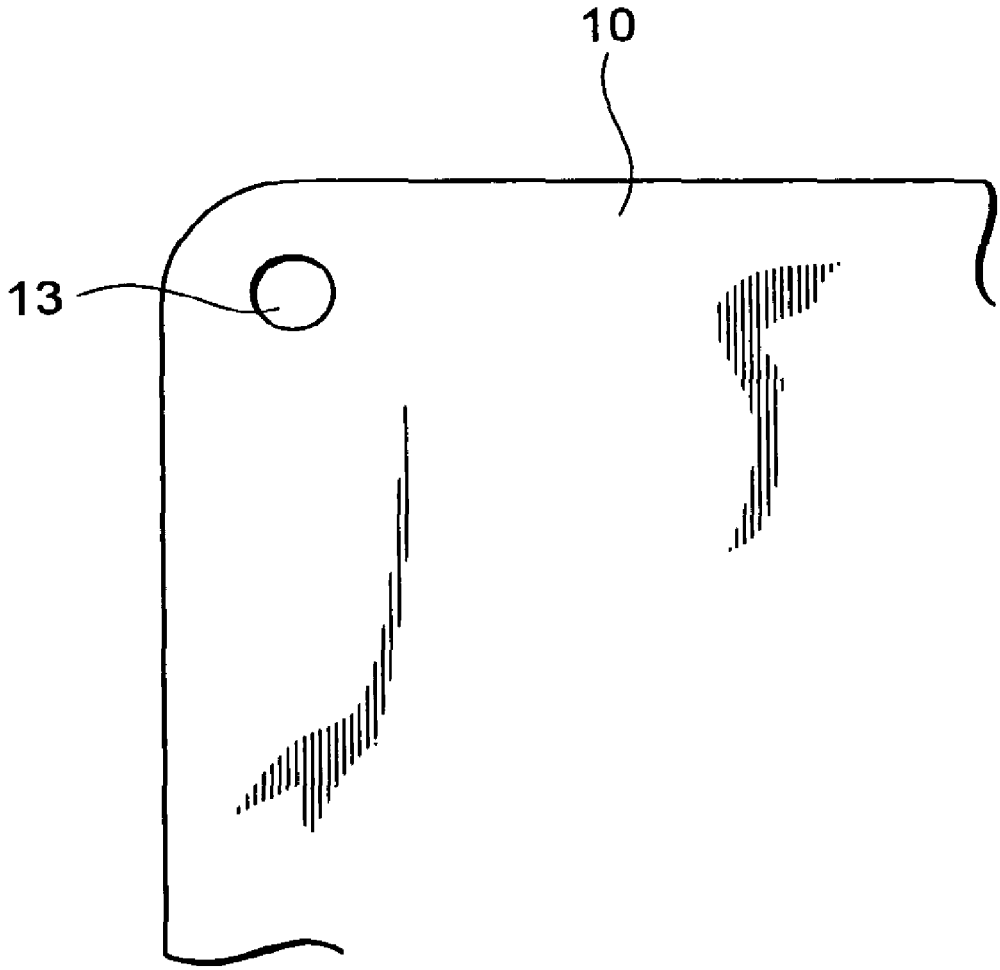
FIG. 8 is an enlarged perspective view of the area around a second engaging member of the primary mat body shown in FIG. 1.
Figure 9:
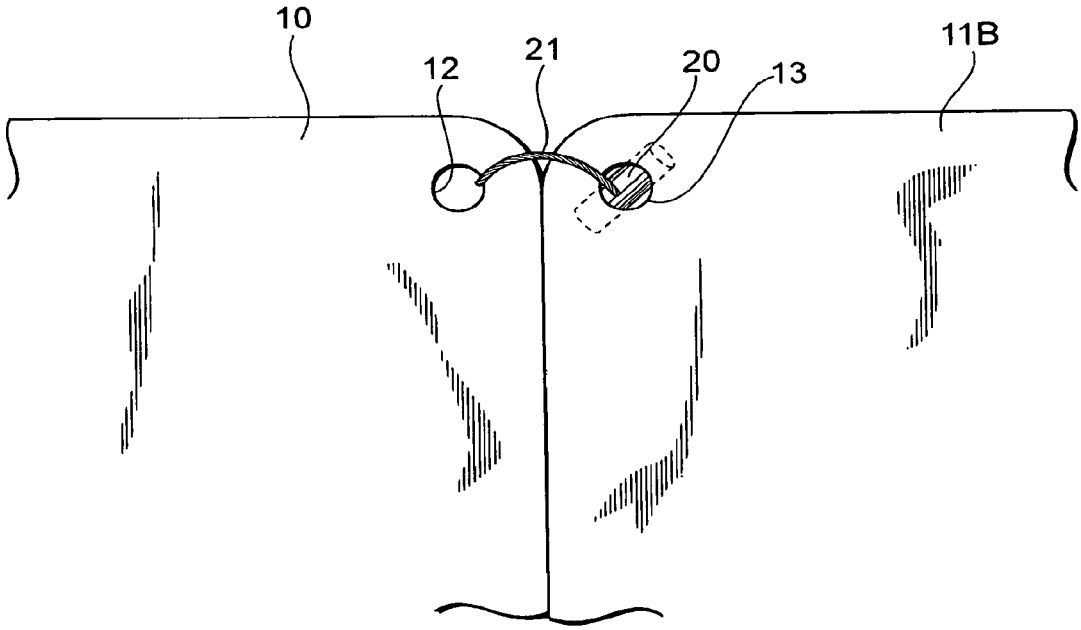
FIG. 9 is an enlarged perspective view illustrating the state where a first engaging member of the primary mat body in FIG. 1 engages with a second engaging member of a connecting mat body.
Figure 10:
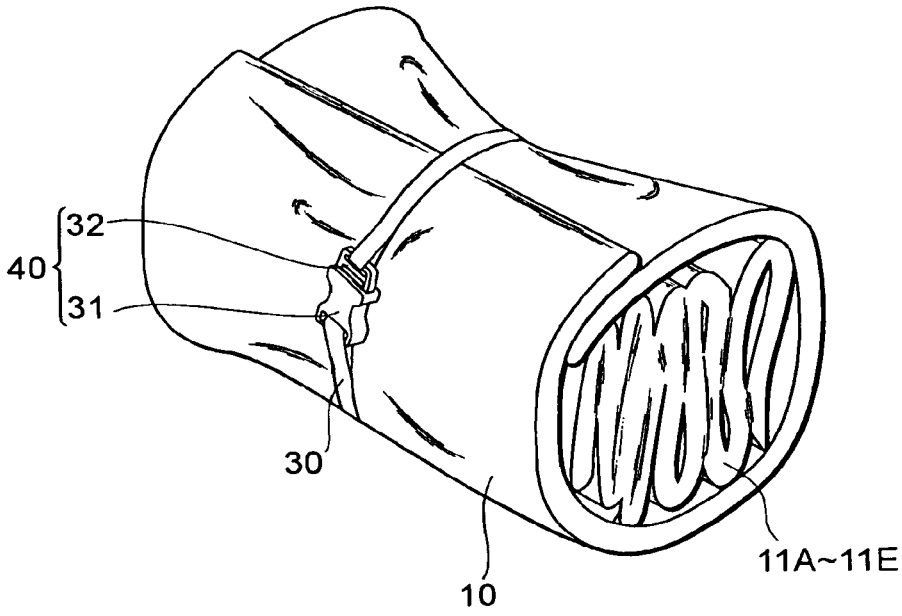
FIG. 10 is a perspective view illustrating the state where the primary mat body, a component of the mat shown in FIG. 1, is bound with the strap.

FIG. 1 is a plan view of a mat according to the first embodiment of this invention. FIG. 2 is a bottom view of a primary mat body, a component of the mat shown in FIG. 1. FIG. 3 is an enlarged perspective view of a sectioned part of the mat shown in FIG. 2 as taken along line III-III. FIG. 4 is an enlarged plan view of an area where the strap is attached to the mat shown in FIG. 1. FIG. 5 is a plan view illustrating the state where the strap on the mat shown in FIG. 1 is used to attach a pillow to the mat. FIG. 6 is an enlarged perspective view illustrating the state where the strap on the mat shown in FIG. 1 is used to attach a pillow to the mat. FIG. 7 is an enlarged plan view of the area around a first engaging member of the primary mat body shown in FIG. 1. FIG. 8 is an enlarged perspective view of the area around a second engaging member of the primary mat body shown in FIG. 1. FIG. 9 is an enlarged perspective view illustrating the state where a first engaging member of the primary mat body in FIG. 1 engages with a second engaging member of the connecting mat body. FIG. 10 is a perspective view illustrating the state where the primary mat body, a component of the mat shown in FIG. 1, is bound with the strap.

As shown in FIGS. 1 to 10, a mat 1 according to the first embodiment includes a primary mat body 10 and five connecting mat bodies 11A to 11E connected to the primary mat body 10.

The primary mat body 10 is of approximately rectangular shape with rounded corners, as seen from above, and holes 12, 13, 14, and 15 are made through the primary mat body 10 near its corners. As second engaging members, toggles 20 are tied and fastened with string 21 to the holes 12 and 14 formed at two of its four corners located at the ends of one diagonal line. A toggle 20 is inserted into any of holes 12 to 15 in the connecting mat bodies 11A to 11E, which are described later in detail, and serves to connect the connecting mat bodies 11A to 11E and the primary mat body 10 together.

A strap 30 that is used to attach a pillow 100 (see FIGS. 5 and 6), or the primary mat body 10 itself, or the connecting mat bodies 11A to 11E or the like, is attached to the approximately central part of one short side of the primary mat body 10. As a length adjustment mechanism, a buckle 40 adjusts the length of the strap 30 is attached to the strap 30.

A female portion 31 of the buckle 40 is attached to the base end of the strap 30 (the position where the strap 30 is attached to the primary mat body 10). Meanwhile, a male portion 32 of the buckle 40 is attached to a position somewhere along the strap 30 and can move along the strap 30. The male portion 32 of the buckle 40 engages with the female portion 31, forming a ring. The buckle 40 is designed so that the diameter (or size) of the strap 30 ring can be changed. Accordingly, when the pillow 100, the primary mat body 10, or the connecting mat bodies 11A to 11E are attached to the mat with the strap 30, the strap 30 can be adjusted to their respective sizes.

Moreover, the primary mat body 10 is an air mat into which air is inserted and stored. An air inlet for introducing air into the primary mat body 10 is formed at one short side of the primary mat body 10 (the edge where the strap 30 is attached in to the first embodiment).

Furthermore, as shown in FIG. 3, the primary mat body 10 includes an air mat 16 into which air is introduced, and a cover 17 placed on the surface of the air mat 16 for covering the surface of the air mat 16. One end 17A of the cover 17 and the end 17B of the cover 17 opposite that end 17A are fixed to each other at the approximately central part of the reverse side of the primary mat body 10 as shown in FIGS. 2 and 3.

Since one end 17A and the other end 17B of the cover 17 are fixed to each other at the approximately central part of the reverse side of the primary mat body 10, it is unnecessary to join the ends 17A and 17B of the cover 17 together along the edges of the primary mat body 10. Therefore, the amount of materials used for the primary mat body 10 and the weight of the primary mat body 10 can be reduced. Also, since mold margins for joining the edges are not required, manufacturing costs can also be reduced. Compared to the case where the edges are joined together, the possibility of fixed parts (or joined parts) coming off can be reduced. Incidentally, the primary mat body 10 can be used by having the surface where the ends 17A and 17B of the cover 17 are joined together, as the upper side of the mat.

The connecting mat bodies 11A to 11E are configured in the same manner as the primary mat body 10, except that they do not have the strap 30 or the buckle 40.

The mat 1 according to the first embodiment is assembled by first placing a connecting mat body 11B adjacent to the primary mat body 10, inserting a toggle 20 fastened with string 21 into the hole 12 in the connecting mat body 11B, into the hole 13 in the primary mat body 10 as shown in FIG. 9, and thereby connecting the connecting mat body 11B to the primary mat body 10 by means of the toggle 20.

In the same manner, a connecting mat body 11A is connected to the primary mat body 10 by means of the toggle 20 by placing the connecting mat body 11A adjacent to the primary mat body 10 on the side opposite the side connected to the connecting mat body 11B, and inserting the toggle 20 fastened with the string 21 into the hole 12 in the connecting mat body 11A, into the hole 13 in the primary mat body 10. The connecting mat bodies 11C to 11E are connected to the primary mat body 10 in the same manner, resulting in the mat 1 configured as shown in FIG. 1. When the mat 1 is prepared in this manner, a desired amount of air may be introduced via air inlets 45 into the primary mat body 10 and the connecting mat bodies 11A to 11E before or after they are connected.

As described above, the primary mat body 10 and the connecting mat bodies 11A to 11E are connected by engaging the toggles 20 with the holes 12 to 15 at the corners of the primary mat body 10 and the connecting mat bodies 11A to 11E. Therefore, the holes 12 to 15 and the toggles 20 neither bother the user nor make the surface of the mat uncomfortable. Accordingly, the user can be comfortable when using the mat 1.

Next, in order to attach a pillow 100 to this mat, a strap 30 is wound around the approximate central part of the pillow 100, the position of the male portion 32 of the buckle 40 is moved to adjust the winding length of the strap 30 for the pillow 100, and then the male portion 32 of the buckle 40 is made to engage with the female portion 31. As a result, the pillow 100 is attached to the mat 1 as shown in FIGS. 5 and 6.

Since the pillow 100 is attached to the mat 1 as described above, it is possible to prevent the pillow 100 from slipping and moving away from the user's head while they are sleeping, whether the mat 1 and the pillow 100 are made of normal materials, or made of slippery materials. Therefore, the mat 1 and the pillow 100 do not disturb the user's sleep and are comfortable to lie on. Also, since the pillow 100 is not used on top of the mat 1, the mat 1 needs to be as long as the length of the user's feet to the user's shoulders. Consequently, the size and weight of the mat 1 can be further reduced.

The pillow 100 can be easily detached from the mat 1 by releasing the engagement between the male portion 32 and the female portion 31 of the buckle 40. Also, when the user wants to carry the mat 1 around or put it away, he/she should let the air out of the primary mat body 10 and the connecting mat bodies 11A to 11E, and then roll up the primary mat body 10 and the connecting mat bodies 11A to 11E together, and can also bind (or tie up) them together with the strap 30 as shown in FIG. 10. Moreover, the user may use the strap 30 to bind only the primary mat body 10, or both the primary mat body 10 and the pillow 100 together.

The first embodiment described the case where five connecting mat bodies 11A to 11E are connected to one mat body 10. However, the invention is not limited to this configuration, and any number of mat bodies 10 and connecting mat bodies 11A to 11E may be connected depending on their respective sizes and the size of the finished mat.

Figure 11:
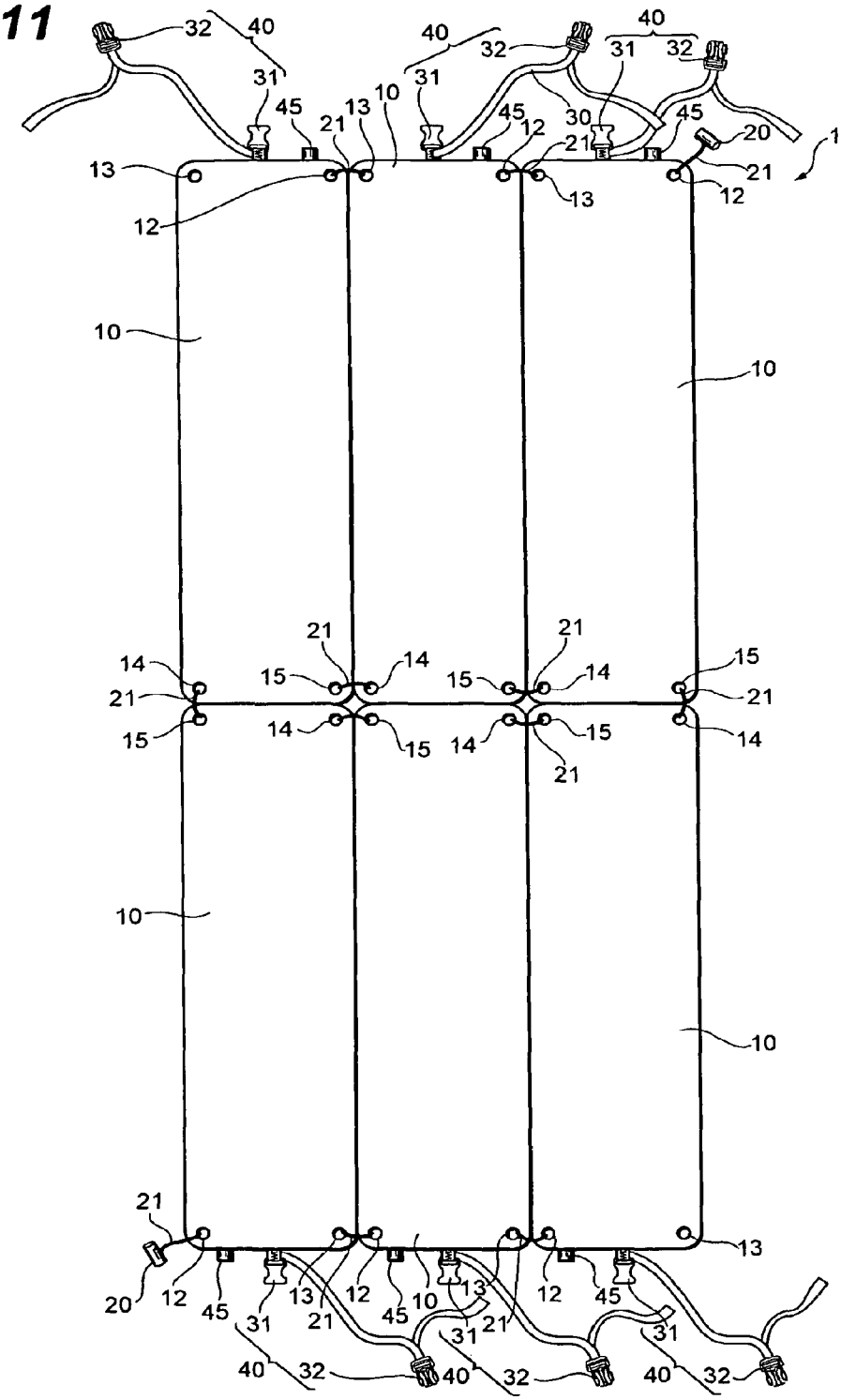
FIG. 11 is a plan view of a mat according to another embodiment of the invention.
Figure 12A:
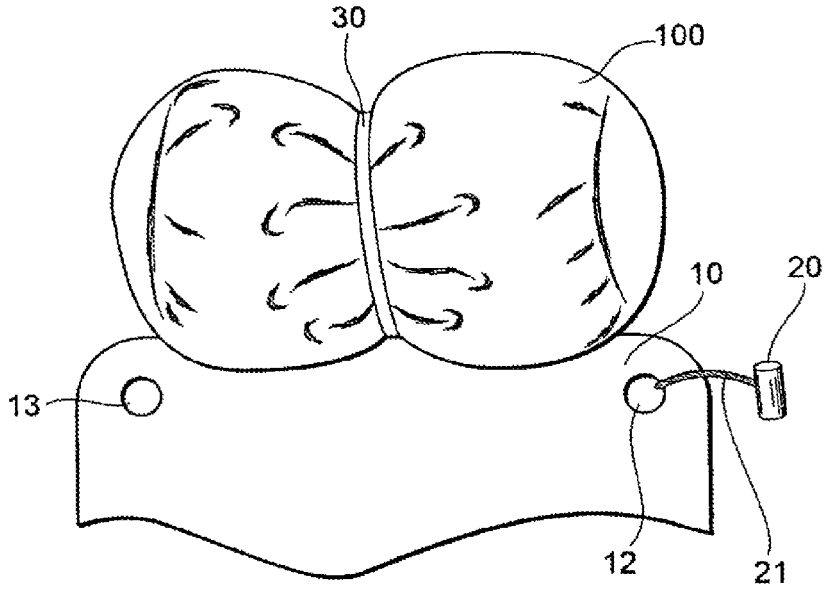
FIG. 12A is a plan view showing the state where a strap on the mat according to a further embodiment of the invention is used to attach a pillow to the mat.

The connecting mat bodies can be connected and used without using the primary mat body 10. Moreover, a plurality of primary mat bodies 10 may be connected as shown in FIG. 11 in the same manner as described in the first embodiment. Furthermore, only one mat body 10 may be used as shown in FIG. 12A, without connecting a plurality of primary mat bodies 10. In this case, it is unnecessary to provide the first engaging members (such as the holes 12 to 15) or the second engaging members (such as the toggles 20).

Moreover, the first embodiment described the case where air mats into which air can be introduced are used as the primary mat body 10 and the connecting mat bodies 11A to 11E. However, the type of mat employed in this invention is not particularly limited to air mats, and the primary mat body 10 and the connecting mat bodies 11A to 11E may be mat bodies, each composed of either a plurality of laminated layers or a single layer.

Furthermore, the first embodiment described the case where the holes 12 to 15 (the first engaging members) are made at the four corners of each of the primary mat body 10 and the connecting mat bodies 11A to 11E, and the toggles 20 (the second engaging members) are provided along one diagonal line in each of the primary mat body 10 and the connecting mat bodies 11A to 11E. However, the invention is not limited to this configuration, and the first engaging members may be formed at least both ends of one edge (or side) of each of the primary mat body 10 and the connecting mat bodies 11A to 11E, and the second engaging members may be formed at both ends of the edge (or side) opposite the above-mentioned edge (or side).

Figure 12B:
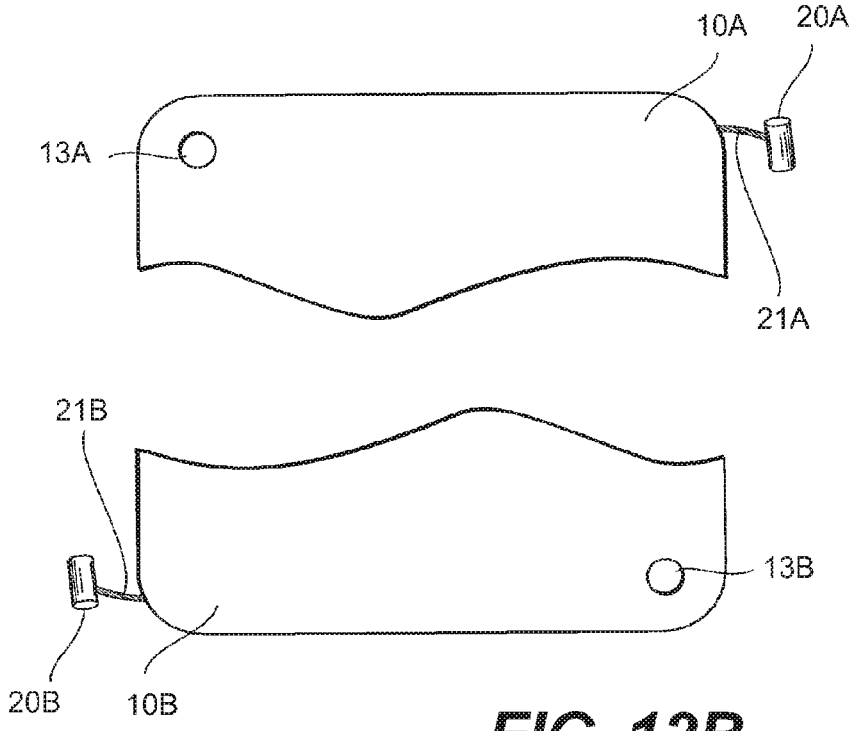
FIG. 12B is a plan view showing upper and lower portions of a mat including a first engaging member (hole) at each of two corners thereof and including a second engaging member (toggle fastened with a string) at each of the other two corners thereof.

If the toggles 20 (the second engaging members) are formed near two corners located at the ends of one diagonal line of each of the primary mat body 10 and the connecting mat bodies 11A to 11E as in the first embodiment, the holes 12 to 15 (the first engaging members) may be made only near two corners located at the ends of another diagonal line intersecting with the above-mentioned diagonal line. Also, the toggles 20 (the second engaging members) may be provided near the four corners of each of the primary mat body 10 and the connecting mat bodies 11A to 11E. Such configuration is shown in FIG. 12B, with a first portion 10A of the mat including a first hole 13A and a first toggle 20A connected to the mat with a first string 21A, and with a second portion 10B of the mat including a second hole 13B and a second toggle 20B connected to the mat with a second string 21B.

Furthermore, the first embodiment described the case where the holes 12 to 15 are formed as the first engaging members, and the toggles 20 are provided as the second engaging members. However, the invention is not limited to this example, and there is no particular limitation on the types of the first engaging members and the second engaging members as long as they can engage with each other. Therefore, it is possible to use various types of engaging members such as Hook-and-loop fasteners, hooks, buttons and button holes, zip fasteners, and strings.

The first embodiment also described the case where a primary mat body of approximately quadrangular shape, as seen from above, is used as the primary mat body 10 and the connecting mat bodies 11A to 11E. However, the invention is not limited to this example, and the shape of the primary mat body 10 and the connecting mat bodies 11A to 11E is not particularly limited and may also be other polygons.

Figure 13:
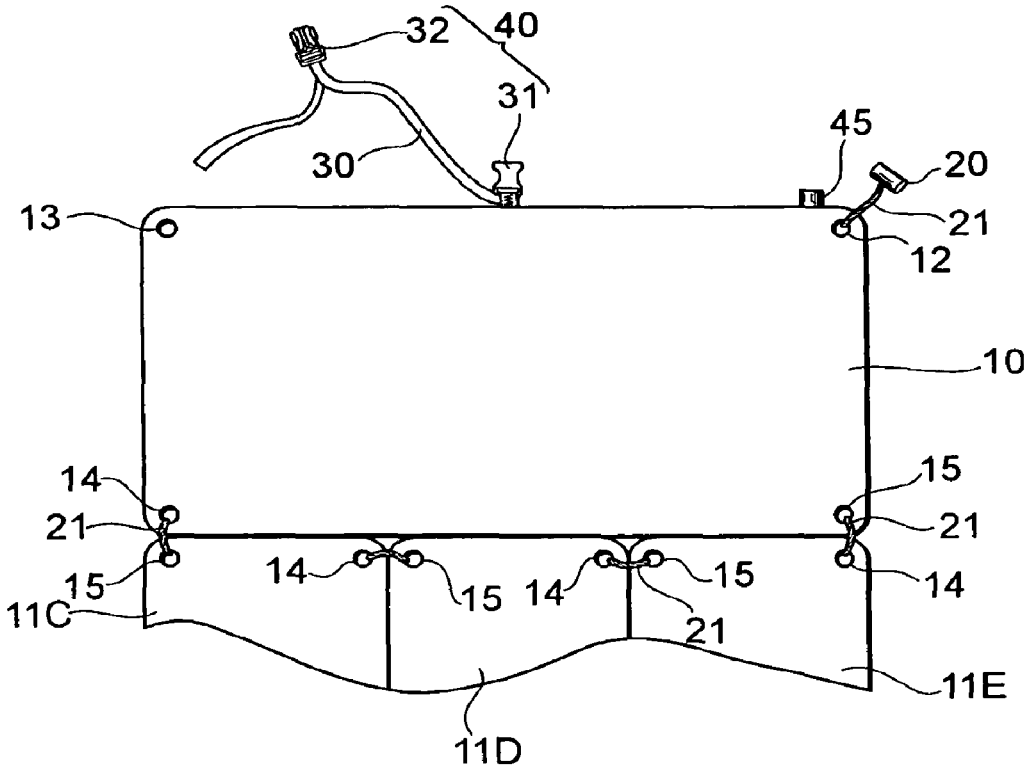
FIG. 13 is a plan view showing the state where the pillow is attached to the mat according to a further embodiment of the invention.

Furthermore, the first embodiment described the case where the primary mat body 10 is connected to a plurality of connecting mat bodies 11A to 11E, each of which is of the same size as that of the primary mat body 10. However, the invention is not limited to this example, and the primary mat body 10 and connecting mat bodies 11A to 11E of different sizes may be used. For example, as shown in FIG. 13, the primary mat body 10 may be a different size from that of the connecting mat bodies 11A to 11E, and this different-sized mat body 10 may be used in place of a pillow by placing the primary mat body 10 at the position where the pillow 100 should be located, and connecting it to the connecting mat bodies. Alternatively, at least one of the connecting mat bodies 11A to 11E may be a different size from that of the remaining connecting mat bodies 11A to 11E and be used in place of a pillow in the same manner as in the above-described example. The same applies to a mat formed by connecting a plurality of primary mat bodies 10.

Second Embodiment

A pillow, a mat, and bedding including the pillow and the mat according to the second embodiment of the invention will be described below with reference to the relevant drawings.

Figure 14:
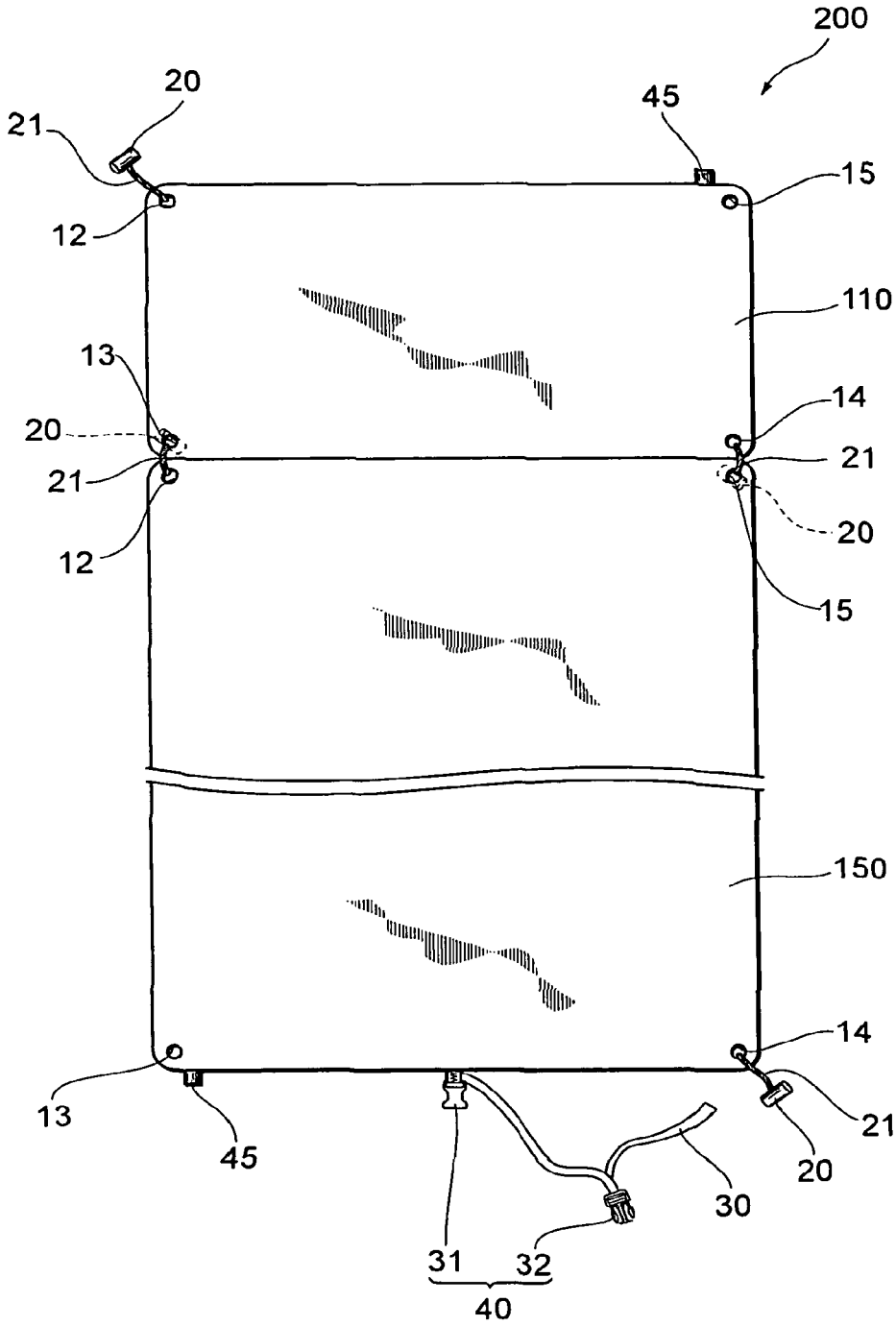
FIG. 14 is a plan view of a pillow, a mat, and bedding according to the second embodiment of the invention.
Figure 15:
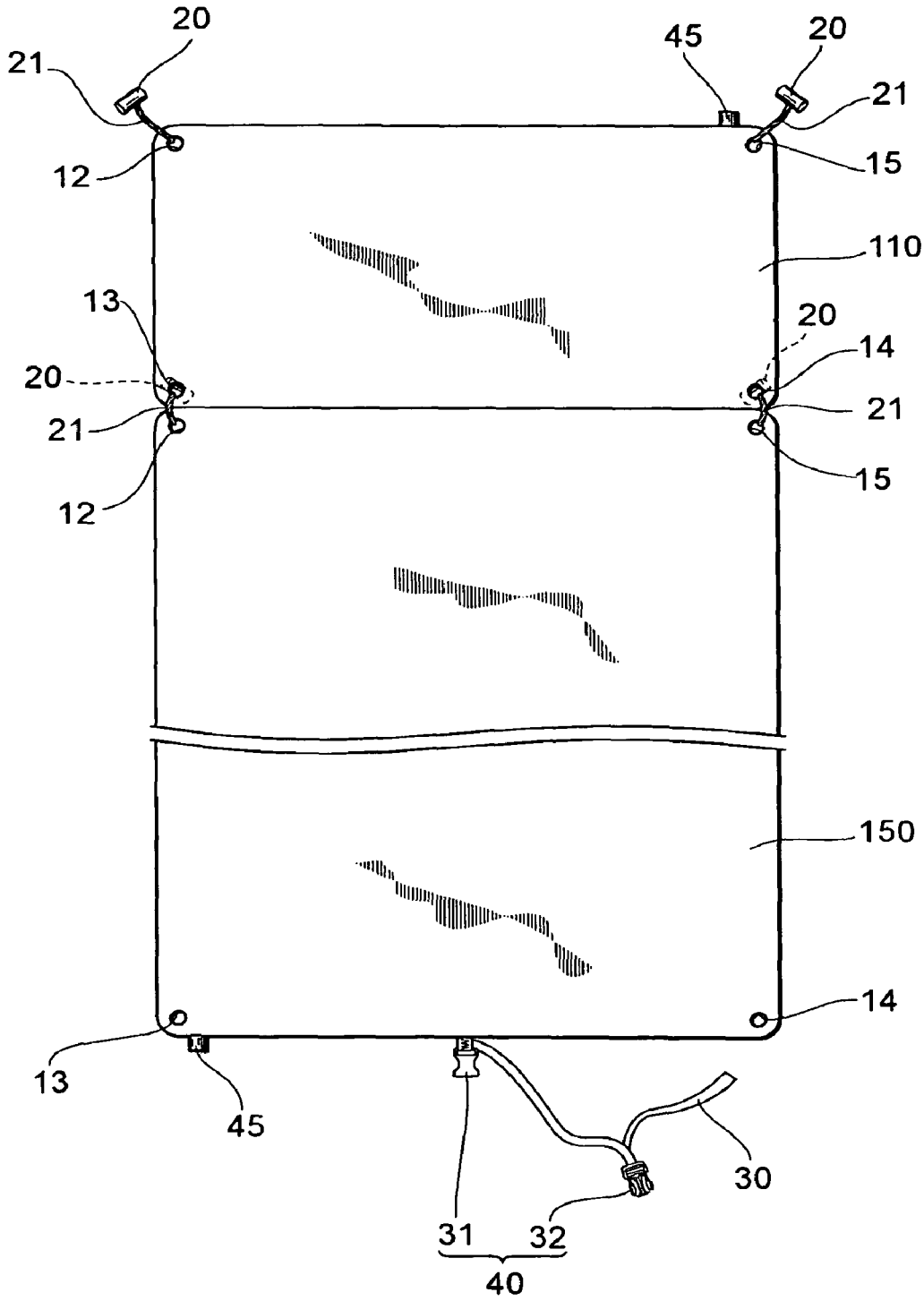
FIG. 15 is a plan view of a pillow, a mat, and bedding according to another embodiment of the invention.

FIG. 14 is a plan view of a pillow, a mat, and bedding according to the second embodiment. The elements used in the second embodiment the same as those explained in the first embodiment are given the same reference numerals as in the first embodiment, and any detailed description thereof is omitted.

As shown in FIG. 14, a pillow 110 according to the second embodiment is a flat plane approximately quadrangular in shape. As seen from above, the pillow 110 is approximately rectangular in shape with curved corners. Holes 12, 13, 14, and 15 are made through the pillow 110 at positions near the curved corners in the same manner as in the first embodiment. Just like the first embodiment, the toggle 20 is tied and fastened with the string 21 to each of the holes 12 and 14 formed at two of its four corners located at the ends of one diagonal line. This pillow 110 is an air pillow which can be filled with air. An air inlet 45 for introducing air into the pillow 110 is formed at one edge of the pillow 110.

The pillow 110, just like the primary mat body 10 and the connecting mat bodies 11A to 11E described above, includes an air mat part into which air is introduced, and a cover placed over the surface of the air mat part in order to cover the surface of the air mat part. One end of this cover and the other end (opposite the aforementioned end) of the cover are fixed to each other at the approximately central region of the reverse side of the pillow 110.

A mat 150 connected to this pillow 110 has a similar configuration as that of the primary mat body 10 described in the first embodiment, and the size of one mat 150 is large enough for an adult person to lie down on. Specifically speaking, the holes 12 to 15 are made near the four corners of the mat 150 and the toggle 20 is tied and fastened with the string 21 to each of the holes 12 and 14 made along a first diagonal line. The strap 30 with the buckle 40 described in the first embodiment is attached to the mat 150. This strap 30 is used in the second embodiment not to attach a pillow to the mat 150, but to roll up and bind (or tie up) the mat 150 as shown in FIG. 10, when carrying around or putting away the mat 150. Just the mat 150 may be bound with the strap 30, or both the mat 150 and the pillow 110 may be bound together with the strap 30, as desired.

The pillow 110 and the mat 150 constitute bedding 200. The bedding 200 is assembled by placing the pillow 110 adjacent to a shorter side of the mat 150 as shown in FIG. 14, inserting the toggle 20 fastened with the string 21 into the hole 12 in the mat 150, into the hole 13 in the pillow 110, and inserting the toggle 20 fastened the with string 21 to the hole 14 in the pillow 110, into the hole 15 in the mat 150. A desired amount of air may be introduced via the air inlets 45 to the mat 150 and pillow 110 before or after connecting (or assembling) them.

As described above, the mat 150 and the pillow 110 are connected by engaging the toggles 20 with the holes 12 and 14 formed at the corners of the mat 150 and the pillow 110 respectively. Therefore, the holes 12 and 14 and the toggles 20 neither bother the user nor make the surface of the mat 150 uncomfortable. Accordingly, the user can be comfortable when using the mat 150.

Since the pillow 110 is connected (or attached) to the mat 150 as described above, it is possible to prevent the pillow 110 from slipping and moving away from the user's head while they are sleeping, whether the mat 150 and the pillow 110 are made of normal materials, or made of slippery materials. Therefore, the mat 150 and the pillow 110 do not disturb the user's sleep and are comfortable to lie on. Also, since the pillow 110 is not used on top of the mat 150, the mat 150 needs to be as long as the length of the user's feet to the user's shoulders. Consequently, the size and weight of the mat 150 can be further reduced.

The pillow 110 can be easily detached from the mat 150 by releasing the engagement between the holes 12 and 14 and the toggles 20. Also, when the user wants to carry around or put away the mat 150, he/she can let the air out of the mat 150 and the pillow 110, and then roll up only the mat 150 or both the mat 150 and the pillow 110 together, and can also bind (or tie up) them together with the strap 30 as shown in FIG. 10.

The second embodiment described the case where the holes 12 to 15 are made at the four corners of each of the pillow 110 and the mat 150, and the toggles 20 are attached with the strings 21 to the holes 12 and 14 formed near two corners located at the ends of the first diagonal line. However, the invention is not limited to this configuration, and the toggle 20 may be attached with the string 21 to each of the holes 12 and 15 at both ends of one edge of each of the mat 150 and the pillow 110.

It is only necessary to provide the holes 13 and 14 on the side of the pillow 110 to be connected to the mat 150. The toggle 20 may be attached with the string 21 to at least one of the holes 13 and 14. Regarding the mat 150 as well, it is only necessary to provide the holes 12 and 15 on the side of the mat 150 to be connected to pillow 110. The toggle 20 may be attached with the string 21 to at least one of the holes 12 and 15.

Figure 16:
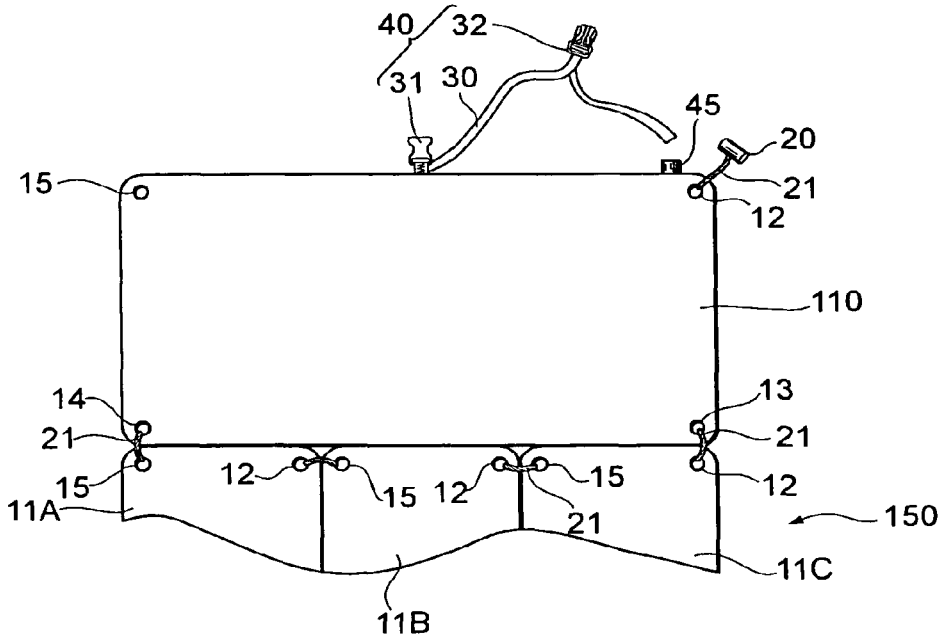
FIG. 16 is a plan view of a pillow, a mat, and bedding according to a further embodiment of the invention.

Furthermore, the second embodiment described the case where one mat 150 of the size allowing an adult person to lie down on is used. However, the invention is not limited to this example, and a plurality of connecting mat bodies 11A to 11C and so on may be connected to constitute the mat 150, to which the pillow 110 may be connected. In this case, the strap 30 with the buckle 40 may be attached to the pillow 110 as shown in FIG. 16. Also, in the same manner as described above, a plurality of primary mat bodies 10 may be connected together to constitute the mat 150, and the pillow 110 may be then connected to this mat 150.

Third Embodiment

Next, a sleeping bag, a mat, and bedding including the sleeping bag and the mat according to the third embodiment of the invention will be described below with reference to the relevant drawings.

Figure 17:
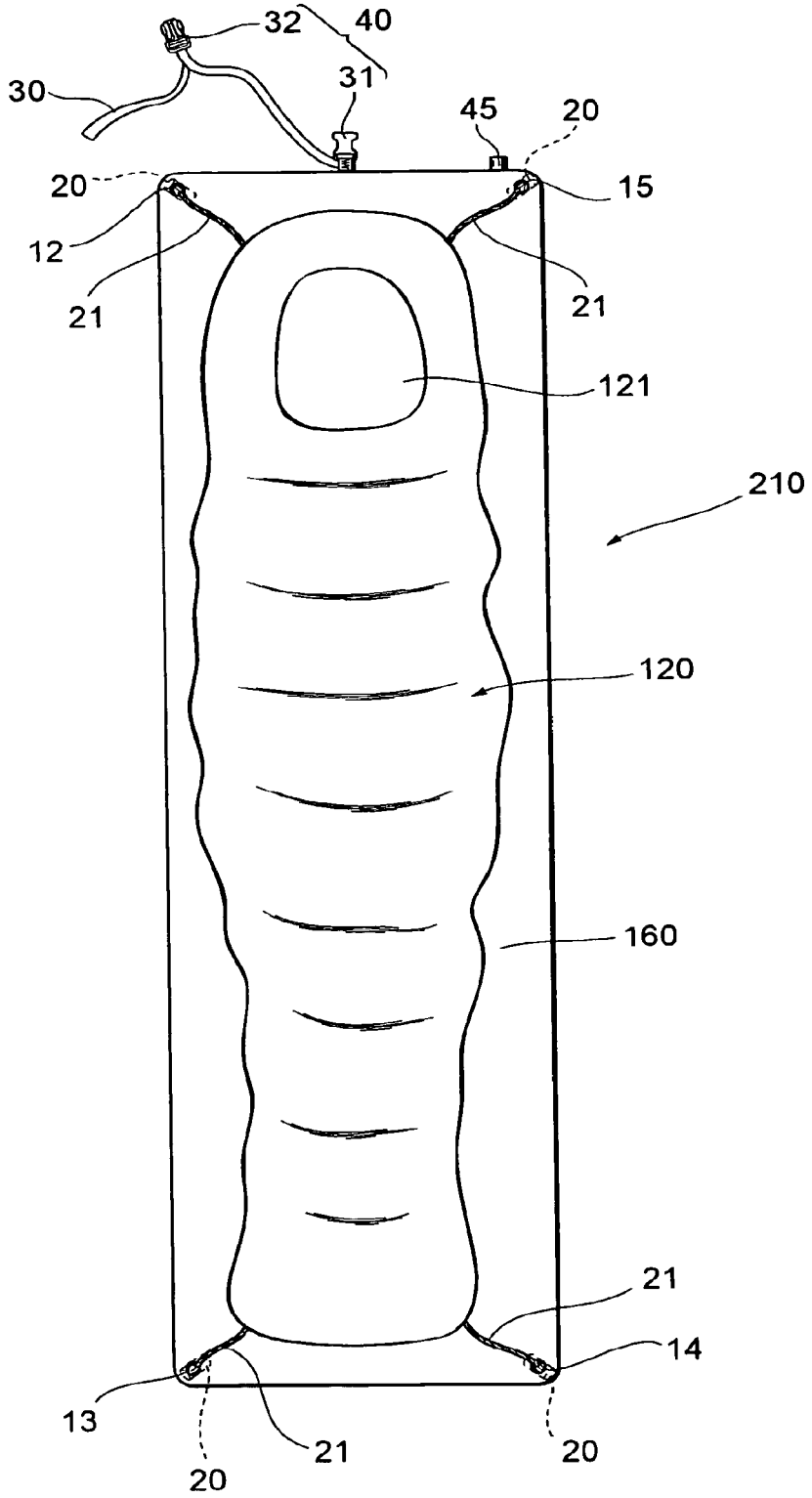
FIG. 17 is a plan view of a sleeping bag, a mat, and bedding according to the third embodiment of the invention.
Figure 18:
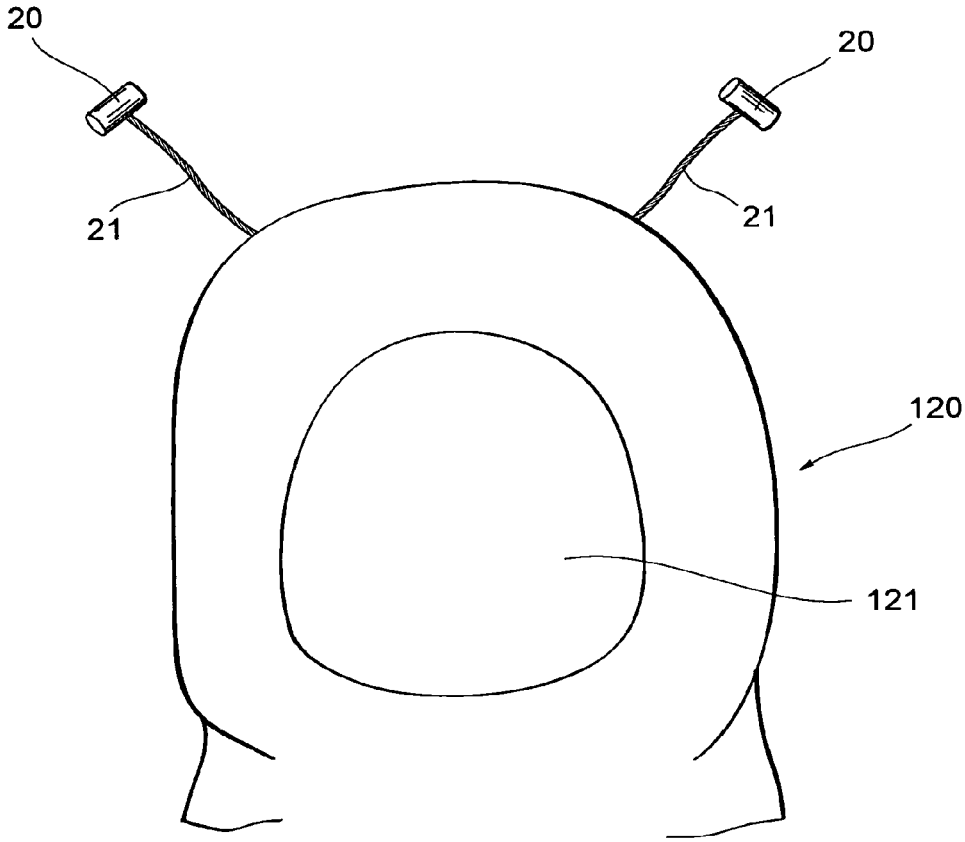
FIG. 18 is an enlarged view of the area near the head region of the sleeping bag shown in FIG. 17.
Figure 19:
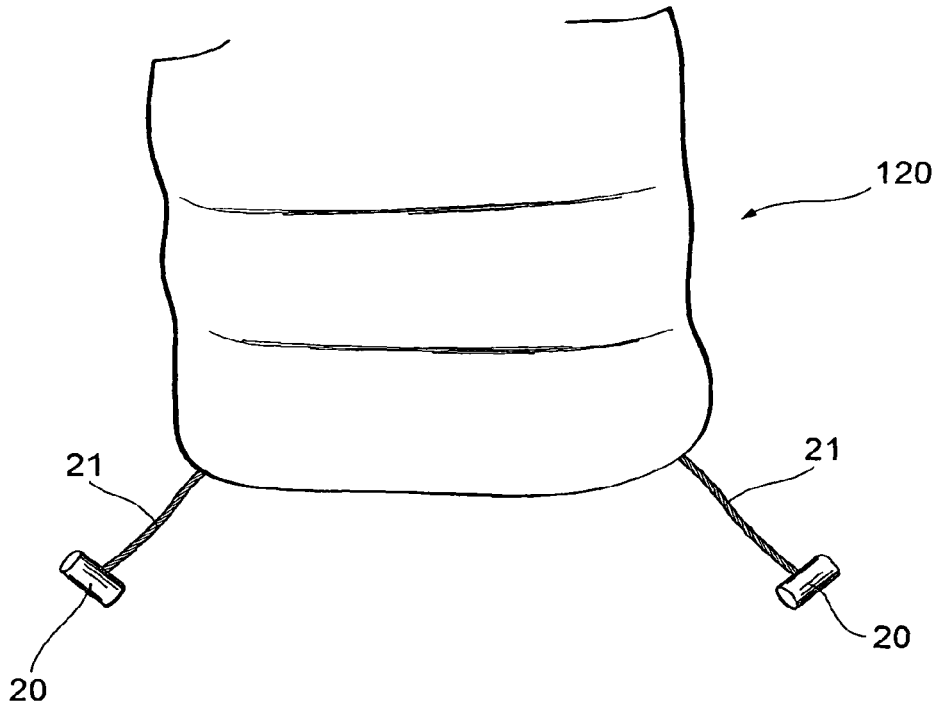
FIG. 19 is an enlarged view of the area near the foot region of the sleeping bag shown in FIG. 17.

FIG. 17 is a plan view of a pillow, a mat, and bedding according to the third embodiment of the invention. FIG. 18 is an enlarged view of an area near the head region of the sleeping bag shown in FIG. 17. FIG. 19 is an enlarged view of an area near the foot region of the sleeping bag shown in FIG. 17. The elements used in the third embodiment the same as those explained in the first embodiment are given the same reference numerals as in the first embodiment, and any detailed description thereof is omitted.

As shown in FIGS. 17 to 19, a sleeping bag 120 according to the third embodiment has an opening 121 so that the user's face can be exposed when the user is in the sleeping bag 120. As shown in FIG. 18, the toggles 20 are fastened with the strings 21 to the sleeping bag 120 at two positions spaced apart from each other on the side of the sleeping bag 120 where the user's head will be located when the user is in the sleeping bag 120. Also, as shown in FIG. 19, the toggles 20 are fastened with the strings 21 to the sleeping bag 120 at two positions spaced apart from each other on the side of the sleeping bag 120 where the user's feet will be located. These toggles 20 are attached at positions allowing them to engage with the holes 12 to 15 respectively formed at the four corners of a mat 160 described below in detail. As shown in FIGS. 17, 18, 19, and 22, the strings 21 and toggles 20 are disposed exclusively at four peripheral positions of the sleeping bag 120, and the remainder of the sleeping bag is devoid of any additional strings or toggles.

The mat 160 on which the sleep bag 120 is mounted is of an approximately rectangular shape as seen from above, and is of a size allowing the user in the sleeping bag 120 to lie down on. The holes 12, 13, 14, and 15, with which the toggles 20 attached to the sleeping bag 120 engage, are made at the four corners of the mat 160. Also, the strap 30 with the buckle 40 as described in the first embodiment is attached to the mat 160. In the third embodiment, this strap 30 is used to roll up the mat 160 and bind (or tie up) the mat 160 as shown in FIG. 10 when the user carries around or puts away the mat 160. The strap 30 may be used to bind only the mat 160 or both the mat 160 and the sleeping bag 120, as desired. This mat 160 is configured in the same manner as the primary mat body 10 described in the first embodiment, except that no toggle 20 is attached with the string 21 to the hole 12 or 14.

The sleeping bag 120 and the mat 160 constitute bedding 210. The bedding 210 is assembled by placing the sleeping bag 120 on the mat 160 as shown in FIG. 17, and inserting a toggle 20 fastened with the string 21, into each hole 12 to 15 in the mat 160. A desired amount of air may be introduced via the air inlet 45 to the mat 160 before or after connecting (or assembling) them.

The sleeping bag 120 is connected (or attached) to the mat 160 as described above. Accordingly, it is possible to prevent the sleeping bag 120 from slipping and moving away from the mat while they are sleeping even if the user tosses around in the sleeping bag 120, whether the mat 160 and the sleeping bag 120 are made of normal materials, or made of slippery materials. Therefore, the mat 160 and the sleeping bag 120 do not disturb the user's sleep and are comfortable to lie on and sleep in.

Figure 20:
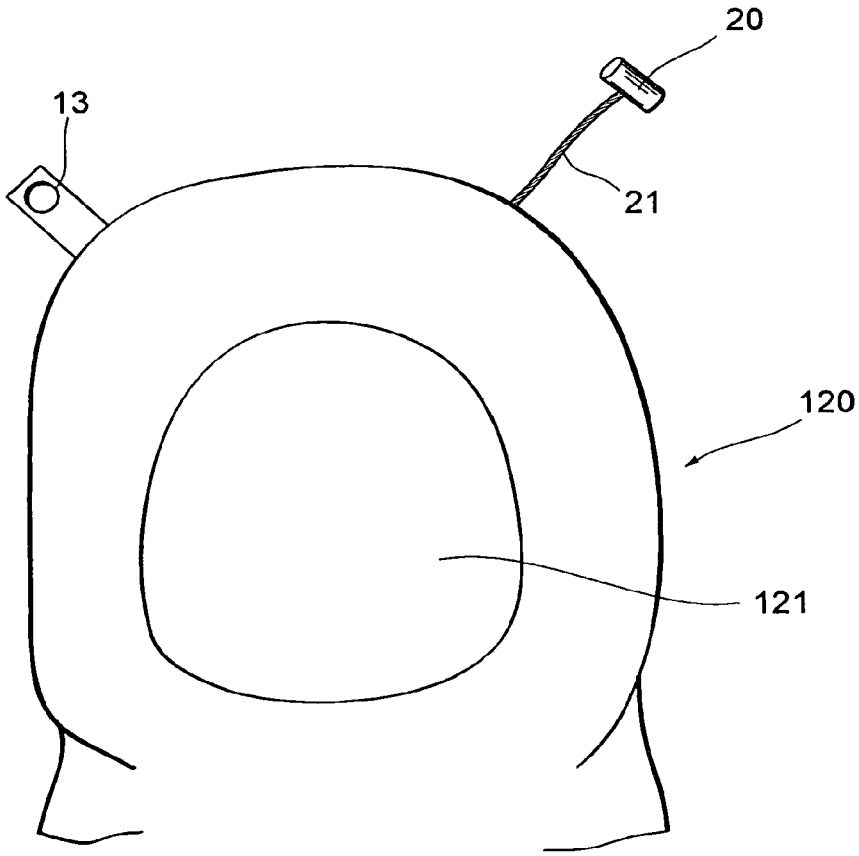
FIG. 20 is an enlarged view of the area near the head region of a sleeping bag according to a further embodiment of the invention.
Figure 21:
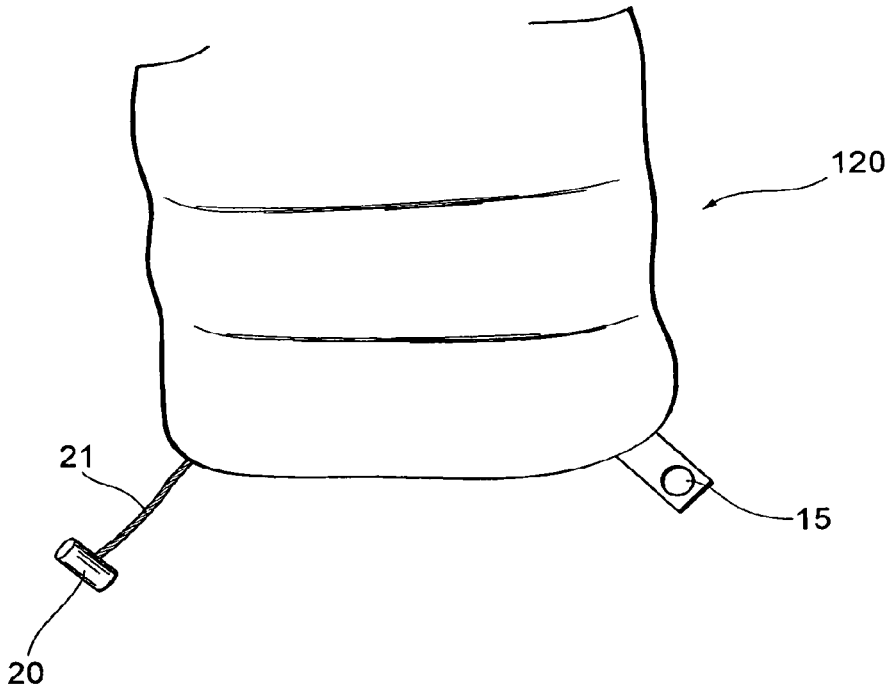
FIG. 21 is an enlarged view of the area near the foot region of a sleeping bag according to a further embodiment of the invention.

The third embodiment described the case where the holes 12 to 15 are made at the four corners of the mat 160, and the toggles 20 are attached with the strings 21 to the sleeping bag 120 at the positions allowing the toggles 20 to engage with the holes 12 to 15 in the mat 160. However, the invention is not limited to this configuration. As shown in FIG. 20, the hole 13 may be made at one of two positions spaced apart from each other along the edge of the sleeping bag 120 on the side where the user's head will be located when the user is in the sleeping bag 120, and the toggle 20 may be fastened with the string 21 to the other position; and as shown in FIG. 21, the toggle 20 may be fastened with the string 21 to one of two positions spaced apart from each other along the edge of the sleeping bag 120 on the side where the user's feet will be located, and the hole 15 may be made at the other position. In this case, the holes 12 and 14 may be made at two of the four corners of the mat 160, located at the positions allowing engagement with the toggles 20 attached to the sleeping bag 120, and the toggles 20 may be provided at the positions on the mat 160 allowing engagement with the holes 13 and 15 in the sleeping bag 120. Also, the holes 12 and 14 may be made in the sleeping bag 120 as in the first and second embodiments, and the toggles 20 may be fastened with the strings to the holes 12 and 14. The same applies to the mat 160.

Figure 22:
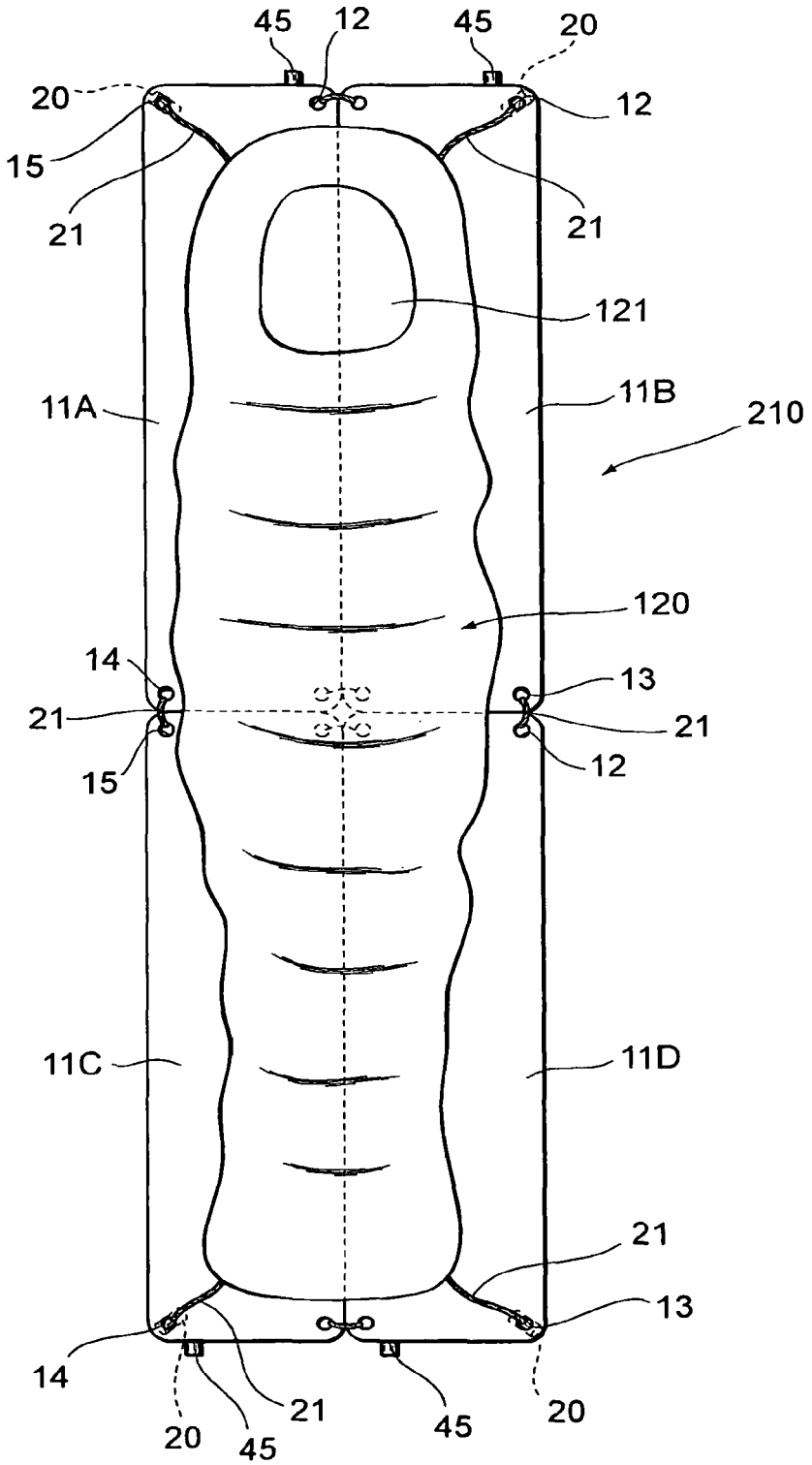
FIG. 22 is a plan view of a sleeping bag, a mat, and bedding according to a further embodiment of the invention.

Furthermore, the third embodiment described the case where one mat 160 of a size allowing an adult person to lie down on is used. However, the invention is not limited to this example, and a plurality of connecting mat bodies 11A to 11D and so on may be connected to constitute the mat 160, to which the pillow 120 may be connected as shown in FIG. 22. In this case, the positions of the holes 12 to 15 and the toggles 20 in the mat 160 should be decided according to the positions of the toggles 20 attached to the sleeping bag 120 and the holes in the sleeping bag 120. Also, in this case, the strap 30 with the buckle 40 can also be attached or not be attached to any of the connecting mat bodies 11A to 11D and so on, although it is not particularly shown in FIG. 22.

What is claimed is:

1. Bedding comprising a mat and a sleeping bag placed over and attached along an upper surface of the mat, wherein:

the mat has two first engaging members of the mat and two second engaging members of the mat, with a single first engaging member of the mat located in or along the upper surface at each of two first corners of the mat, and a single second engaging member of the mat located in or along the upper surface at each of two second corners of the mat that differ from the two first corners of the mat;

the sleeping bag has first engaging members of the sleeping bag adapted to engage with the second engaging members of the mat, with a first engaging member of the sleeping bag being located near each of the two first peripheral positions of the sleeping bag;

the sleeping bag has second engaging members of the sleeping bag adapted to engage with the first engaging members of the mat, with a second engaging member of the sleeping bag being located near each of the two second peripheral positions of the sleeping bag; and the first engaging members of the mat engage with the second engaging members of the sleeping bag, and the second engaging members of the mat engage with the first engaging members of the sleeping bag, thereby connecting the mat and the sleeping bag together;

wherein the mat and the sleeping bag are devoid of additional engaging members corresponding in type to the first or second engaging members, other than the first or second engaging members disposed in or along the upper surface at multiple corners of the mat and disposed near the peripheral positions of the sleeping bag; and wherein the first engaging members differ in type from the second engaging members.

2. The to sleeping bag of claim 1, wherein each first engaging member comprises a hole and each second engaging member comprises a toggle fastened with a string and adapted for insertion into the hole of a first engaging member.

3. The sleeping bag of claim 1, wherein at least a portion of each first engaging member of the sleeping bag and at least a portion of each second engaging member of the sleeping bag is disposed proximate to the upper surface of the mat when the sleeping bag is placed along the upper surface of the mat.

4. Bedding comprising a mat and a sleeping bag placed over and attached along an upper surface of the mat, wherein:

the mat has four corners and four first engaging members, with a single first engaging member located in or along the upper surface at each corner of the four corners of the mat, the sleeping bag has four peripheral positions and four second engaging members, with one second engaging member located at each peripheral position of the four peripheral positions of the sleeping bag, with the second engaging members being adapted to engage the first engaging members of the mat;

the first engaging members of the mat engage with the second engaging members of the sleeping bag, thereby connecting the mat and the sleeping bag together;

the first engaging members differ in type from the second engaging members; and the mat and the sleeping bag are devoid of additional engaging members corresponding in type to the first or second engaging members, other than the first or second engaging members disposed in or along the upper surface at the four corners of the mat and disposed at the four peripheral positions of the sleeping bag.

5. The to sleeping bag of claim 4, wherein each first engaging member comprises a hole and each second engaging member comprises a toggle fastened with a string and adapted for insertion into the hole of a first engaging member.

6. The sleeping bag of claim 4, wherein at least a portion of each second engaging member is disposed proximate to the upper surface of the mat when the sleeping bag is placed along the upper surface of the mat.

* * * * *